US007240513B1

(12) United States Patent
Conforti

(10) Patent No.: US 7,240,513 B1
(45) Date of Patent: Jul. 10, 2007

(54) THERMALLY-CONTROLLED PACKAGE

(76) Inventor: Carl J. Conforti, P.O. Box 6315, Fall River, MA (US) 02724

( * ) Notice: Subject to any disclaimer, the term of this patent is extended or adjusted under 35 U.S.C. 154(b) by 112 days.

(21) Appl. No.: 11/050,989

(22) Filed: Feb. 5, 2005

Related U.S. Application Data

(60) Provisional application No. 60/561,398, filed on Apr. 12, 2004.

(51) Int. Cl.
*F25D 3/08* (2006.01)

(52) U.S. Cl. ..... 62/457.2; 62/457.5

(58) Field of Classification Search ..... 62/297, 62/371, 457.2, 530, 457.5; 206/313, 593
See application file for complete search history.

(56) References Cited

U.S. PATENT DOCUMENTS 4,796,758 A * 1/1989 Hauk ..... 206/545
4,812,054 A * 3/1989 Kirkendall ..... 383/110
5,062,557 A * 11/1991 Mahvi et al. ..... 224/153
5,305,471 A * 4/1994 Steele et al. ..... 2/102
5,377,862 A * 1/1995 Oakes et al. ..... 220/513
5,533,361 A * 7/1996 Halpern ..... 62/457.2
5,638,979 A * 6/1997 Shea ..... 220/1.6
5,758,513 A * 6/1998 Smith ..... 62/457.5
5,865,314 A * 2/1999 Jacober ..... 206/570
6,253,570 B1 * 7/2001 Lustig ..... 62/457.2
6,427,475 B1 * 8/2002 DeFelice et al. ..... 62/457.2
6,544,614 B1 * 4/2003 Huffer et al. ..... 428/40.1
6,686,003 B2 * 2/2004 Legare ..... 428/34.4

FOREIGN PATENT DOCUMENTS

EP 37545 A2 * 10/1981
GB 2245361 A * 1/1992

* cited by examiner

*Primary Examiner*—Mohammad M. Ali

(57) ABSTRACT

A portable thermally-controlled container system includes an outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case, and an inner case configured to fit in the chamber provided by the outer case, the inner case including a first thermally-reflective layer and a first insulation layer disposed inwardly of the first thermally-reflective layer, the inner case providing a second inner chamber disposed inwardly of the first insulation layer.

34 Claims, 19 Drawing Sheets

THERMALLY-CONTROLLED PACKAGE

CROSS-REFERENCE TO RELATED ACTIONS

This application claims the benefits of U.S. Provisional Patent Application Ser. No. 60/561,398, filed Apr. 12, 2004.

BACKGROUND

Thermal controlled packaging can be utilized to store and transport materials while maintaining the materials within a desired temperature range. Various temperature conditions may affect the materials, e.g., the performance characteristics of the materials transported and the packaging preferably inhibits the outside conditions' effects upon the materials within the package. Packages may be subject to freezing and elevated temperatures during transport, e.g., through different global regions by both surface and air carriers. Transport temperatures may vary by 30° F. or more. It has been suggested to assume a transport temperature test profile range for varying ambient temperatures for refrigerated transport from about 70° F. to about 100° F., although other temperature profiles have been noted for temperature controlled packaging tests.

Many products are tested and labeled by the manufacturer with recommended storage and transport temperatures. In some instances, temperature-sensitive material can be stored frozen to preserve the material and extend the product life for an extended period of time. It has become more common in the pharmaceutical marketplace to transport and/or store medications at refrigerated temperatures, e.g., from manufacturer's distribution to vendors, during pharmacy and patient transport, etc. Temperature-sensitive products intended for storage may be in liquid or solid form and the manufacturer and/or distributor are typically responsible for the transport temperature ranges specified for the product (e.g., drug) stability and use.

For pharmaceuticals, preferred refrigerated temperatures are typically in the range of about 36° F. to about 46° F. (about 3° C. to about 8° C.) and commonly in the range of about 32° F. to about 46° F. (about 0° C. to about 8° C.), where manufacturers recommend storage without freezing. Temperatures above about 46° F. can spoil the pharmaceutical and/or significantly impair the effectiveness of the pharmaceutical. Temperatures less than 32° F. can cause some pharmaceuticals to freeze, and can spoil the pharmaceutical and/or significantly impairing its effectiveness. Indeed, many manufacturer specifications instruct not to allow the temperature of the product to fall below 32° F. Pharmaceutical manufacturers and international committees such as HACCP/Hazard Analysis Critical Control Point, FDA and IHC International Committee for Harmonization work with standards for transporting vaccines and medicines, requiring them to maintain a refrigerated temperature during transport and in many cases recommending that the materials not freeze. Temperature ranges have been suggested for general storage (between about 25° C.+/−2° C.), for refrigerated storage (5° C.+/−3° C.), and for freezer storage (−20° C.+/−5° C.). Refrigeration is commonly used to prevent products from being spoiled or to avoid potential performance issues with the products as specified by the manufacturers, regulatory agencies (e.g., FDA), and/or other entities. Some manufacturer recommendations have been noted in the general use and storage specifications not to freeze the drug and to store drugs (e.g., human growth hormone drugs, insulin vials) at a refrigerated temperature between 0° C. and 8° C.

Various devices may be used to store products at refrigerated temperatures. Some devices may use a refrigerator unit that requires electricity and a pump that can be both costly and inefficient, requiring a constant power source to operate effectively. Other devices using an ice or gel pack have been noted to have a tradeoff between portability and transportation time. Devices using apparatus to generate thermal energy to provide a temporary source of cooling (e.g., gel, ice packs, and dry ice) or a continuous source of cooling (e.g., refrigeration means powered by electricity) commonly use insulation to reduce heat transfer and improve overall product efficiency.

Temperature-controlled storage devices used for food and beverage products typically have a range of safe storage temperatures from 32-100° F. A change in temperature may not have an effect on the performance or quality of the stored product if it is cycled from a low temperature point to a high temperature point, e.g., due to changes in outside ambient conditions. These types of products may be refrigerated for consumer appeal, and/or to inhibit spoiling (e.g., of milk) if exposed to higher ambient temperature conditions. Medications and other healthcare products can be more sensitive to temperature changes, and temperature changes may affect critical performance characteristics of medications.

Temperature controlled packaging, sometimes referred to as thermal transport devices, have been developed in both a rigid and semi rigid structures. These structures provide barriers or insulation layers to reduce the effects that outside ambient temperatures may have on contents of internal compartments of the devices. The amounts of insulation thickness, material cost and desired insulation performance are common factors considered in designing an insulated package. Increasing insulation thickness may improve the thermal insulation factor to a certain degree, but also can make transport devices more costly and bulky for transportation. Devices used to transport refrigerated medications are more commonly found in rigid materials. Examples of rigid materials blow molded or roto-molded containers that are filled with insulation material or air evacuated to form a vacuum.

Soft-sided coolers are commonly designed with a resilient exterior casing material, a foam insulation barrier and a water resistant inner liner to hold or store ice and/or other cooling products. These devices typically have a limited capacity to cool in higher or elevated ambient temperatures and can be inefficient to provide a stable temperature controlled environment. Thermoelectric coolers use a power source and other electronic components to maintain a refrigerated temperature and sometimes can be quite costly compared to a soft-sided case with re-usable thermal cooling packs. Thermal insulation is one important design factor in the design of a insulated package where heat (Q, SI unit is Joule) is the amount of thermal energy transferred from one object to another due to temperature differences (in thermodynamics heat flows from a hot to a cold body). Heat can be determined according to:

$$Q=mc\Delta T$$

where m is mass in kg, c is specific heat of the material, and $\Delta T=T_f-T_i$ in ° C. (i.e., change in temperature T is the difference between the final temperature and the initial temperature). This formula can be used to calculate the transfer of heat flow from outside ambient temperature conditions, and the heat loss of thermal cooling element to the system or device. The specific heat of water is very high—higher than ice and steam. Water has a very high specific heat, meaning that it heats slowly and cools slowly. The specific heat of a material provides information about how the material heats and cools.

It is not uncommon for patients or doctors to travel for several hours and have a need for a pharmaceutical that needs to be refrigerated until it is administered. Further, products frequently need to be shipped to remote locations that require constant refrigeration with no power source or electricity available. For short travel times of a few hours, materials such as pharmaceuticals can be transported with existing devices, e.g., in a cooler with ice. Coolers or refrigeration units are typically designed for general use and driven by manufacturing costs without needing a controlled temperature range. Environmental chambers can offer a controlled temperature environment but are costly and difficult to transport. Medical or patient transport cases are typically limited to specific uses and may require custom designs to accommodate the manufacturer's recommended storage temperatures. Some transport devices are made of Styrofoam materials with multiple layers of foam and are quite bulky and possibly unsafe, some containing dry ice as the cooling agent. For travel times longer than a few hours, temperature-sensitive materials such as pharmaceutical typically needs to be obtained at the destination location, with the temperature-sensitive material being stored and refrigerated at the destination. Thus, often patients are restricted to travel due to their health conditions and the medications they are prescribed and the availability of those medications.

SUMMARY

In general, in an aspect, the invention provides a portable thermally-controlled container system including an outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case, and an inner case configured to fit in the chamber provided by the outer case, the inner case including a first thermally-reflective layer and a first insulation layer disposed inwardly of the first thermally-reflective layer, the inner case providing a second inner chamber disposed inwardly of the first insulation layer.

Implementations of the invention may include one or more of the following features. The outer case includes a second thermally-reflective layer and a second insulation layer disposed outwardly of the second thermally-reflective layer. The first and second thermally-reflective layers comprise an aluminum foil. At least one of the inner and outer cases has a non-woven fabric layer adjacent to its corresponding thermally-reflective layer. The system further includes a temperature indicator configured to provide an indication of a temperature in the second inner chamber, the indication being detectable outside of the outer case while the outer case is in the closed position. The temperature indicator comprises a thermochromatic ink. The temperature indicator is configured to provide an indication of whether the temperature in the second inner chamber is in a safe zone. The indication is at least one of visible and audible.

Implementations of the invention may also include one or more of the following features. The system further includes a cooling element configured to be disposed in the first inner chamber with the inner case with the outer case in the closed position wherein the inner case and the cooling element substantially fill the first inner chamber with the outer case in the closed position. The inner case includes a side wall with a first shape and wherein the cooling element has a side wall with a second shape that is substantially similar to the first shape. The cooling element includes a plurality of separate cooling volumes connected together such that the cooling element is configured to be wrapped around multiple walls of the inner case. The inner case includes a plurality of adaptive holders configured to hold multiple sizes of packages containing temperature-sensitive materials. The adaptive holders are disposed and configured to hold the packages in the inner case away from end walls of the inner case. The outer case includes a first body and a first lid pivotally connected to the body, the case further comprising a closure mechanism configured to releasably connect the lid to the body is a substantially air tight manner. The inner case includes a second lid pivotally coupled to a second body and wherein the second body is slightly taller than the first inner chamber such that when the first lid is pivoted from an open position to a closed position to close the outer bag, the first lid will interfere with the second lid, causing the second lid to pivot toward the second body into a closed position. At least one of the outer case and the inner case includes a cooling element configured to be repeatedly frozen and thawed disposed in a wall of the respective case. The outer case comprises an insulation layer that is substantially uniform in thickness about a lateral perimeter of the outer case.

In general, in an aspect, the invention provides an insulated container system for transporting temperature-sensitive materials in a cooled environment inside the system for extended periods of time while the system is exposed to higher temperatures than in the cooled environment, the system including: an outer case including an outer shell layer, a first insulation layer, and a first liner layer, the first liner layer comprising a first thermally-reflective material, the insulation layer being disposed between the outer shell layer and the first liner layer, the outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case; an inner case configured to fit in the chamber provided by the outer case, the inner case including a second liner layer and a second insulation layer, the second liner layer comprising a second thermally-reflective material, the second insulation layer being disposed inwardly of the second liner layer, the inner case providing a second inner chamber disposed inwardly of the second insulation layer; and at least one cooling element configured to be repeatedly frozen and thawed by absorbing thermal energy, where the inner case and the at least one cooling element are configured to substantially fill the first inner chamber.

Implementations of the invention may include one or more of the following features. The system further includes temperature indicating means connected to at least one of the inner case and the outer case for providing an indication of temperature in the second inner chamber. The indication is at least one of visible and audible. The indicating means includes a window through the outer case for viewing the indication without opening the outer case. The temperature indicating means is configured to indicate whether the temperature is between about 36° F. and about 46° F. The temperature indicating means is configured to indicate that the temperature is between about 36° F. and about 46° F. but near at least one of 36° F. and 46° F.

Implementations of the invention may also include one or more of the following features. The inner case further includes a non-woven fabric layer disposed outwardly of the second liner layer. The outer case further includes a non-woven fabric layer disposed inwardly of the first liner layer. The at least one cooling element includes a non-woven fabric outer layer. At least a portion of the outer case further includes a third liner layer disposed between the outer shell layer and the first insulation layer and comprising a third thermally-reflective material. The first and second liner layers comprise an aluminum foil.

In general, in an aspect, the invention provides a portable thermally-controlled container system including an outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case, and an inner case configured to fit in the chamber provided by the outer case, the inner case providing a second inner chamber disposed inwardly of the first insulation layer, the inner case including a cooling device disposed in a wall of the inner case, the cooling device including material configured to be repeatedly frozen and warmed to store and release thermal cooling energy.

Implementations of the invention may include one or more of the following features. The inner case includes a first thermally-reflective layer and a first insulation layer disposed inwardly of the first thermally-reflective layer. The outer case includes a second thermally-reflective layer and a second insulation layer disposed outwardly of the second thermally-reflective layer.

In general, in an aspect, the invention provides a portable thermally-controlled container system including an outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case, an inner case configured to fit in the chamber provided by the outer case, the inner case providing a second inner chamber disposed inwardly of the first insulation layer, and a temperature indicator configured to sense a temperature in the inner case and to provide an indication of the temperature that is observable outside of the outer case without opening the outer case.

Implementations of the invention may include one or more of the following features. The temperature indicator is configured to indicate whether the temperature is within a desirable temperature range. The temperature indicator is configured to indicate whether the temperature is near an extreme of the desirable temperature range. The temperature indicator is disposed through a wall of the inner case. The temperature indicator comprises a window through the inner case.

Various embodiments of the invention may provide one or more of the following capabilities. Articles requiring a temperature-controlled environment can be stored and transported. Such articles may be transported through a range of ambient temperature conditions. Conductive, convective, and/or radiant heat transfer between a temperature-sensitive material and an ambient environment can be inhibited during transport of the material to inhibit effects of such heat transfer. Temperature-sensitive materials may be held in a container and maintained within a temperature range of about 32° F. or 36° F. to about 46° F. for extended periods of time, e.g., up to 14 hours or more, without introducing external cooling to the container and without freezing the materials. Temperature sensitive materials can be transported along with accessories associated with the materials. Temperature-sensitive materials may be transported conveniently. A temperature-controlled environment can be provided for an extended period of time in a container that is more easily transported than prior devices. An indication of temperature in the vicinity of temperature-sensitive materials being transported in a container can be observed without opening the container. An indication that a safe temperature for temperature-sensitive materials is present may be provided. An indication that a temperature outside of a safe zone has been reached may be provided. Visual and/or audible indications of safe and/or unsafe temperatures may be provided. Indications of temperature may be configured integrally as part of the package or as components within the package. Reductions in thermal efficiency from vapor or moisture forming on cooling elements may be inhibited. Freezing of contents of a temperature-controlled container is inhibited. Medications and accessories may be transported in a convenient manner, with the medications being held within a relatively stable, cool temperature range. Containers can be provided for storing and transporting materials in a cooled environment that are one-fifth or smaller than the size of current systems for such use. Thermal cooling devices can provide more uniform distribution of thermal cooling energy. Medications can be stored and refrigerated and transferred from one refrigerated environment to a transport package while inhibiting effects of heat transfer and thermal insulation loss between the medications and an ambient environment. A soft, portable, compact, reusable thermal-controlled package to transport temperature-sensitive materials (e.g., for shipping or personal use) is provided. Substantially uniform cooling can be provided to, e.g., over a height of and/or around, an inner chamber of a container. These and other capabilities of the invention, along with the invention itself, will be more fully understood after a review of the following figures, detailed description, and claims.

DETAILED DESCRIPTION OF PREFERRED EMBODIMENTS

Embodiments of the present invention provide a thermal-controlled package to store temperature sensitive materials within a temperature-controlled environment (e.g., a refrigerated environment). In particular, embodiments of the invention provide techniques for storing and transporting temperature-sensitive materials in a relatively stable, refrigerated environment for extended periods of time using one or more cooling devices such as ice packs, gel packs, etc. For example, a system for transporting temperature-sensitive materials in a cool environment includes a portable insulated bag or case with a thermally-reflective inner layer with insulation disposed outwardly of the reflective layer. A pouch is configured to hold the temperature-sensitive material and to fit within a cavity provided by the insulated bag or case. The pouch includes a thermally-reflective layer and insulation disposed inwardly of the reflective layer of the pouch, with the insulation disposed between the pouch reflective layer and the temperature-sensitive material with the material disposed in the pouch. One or more cooling elements are disposed within the case. The case, pouch, and cooling element(s) are configured such that the cavity provided by the case is substantially filled by the pouch and cooling element(s) when these items are received by the case. The cooling elements provide an insulating layer along with thermal cooling energy to maintain a desired temperature from outside ambient temperature conditions. Other embodiments are within the scope of the invention.

Figure 1:
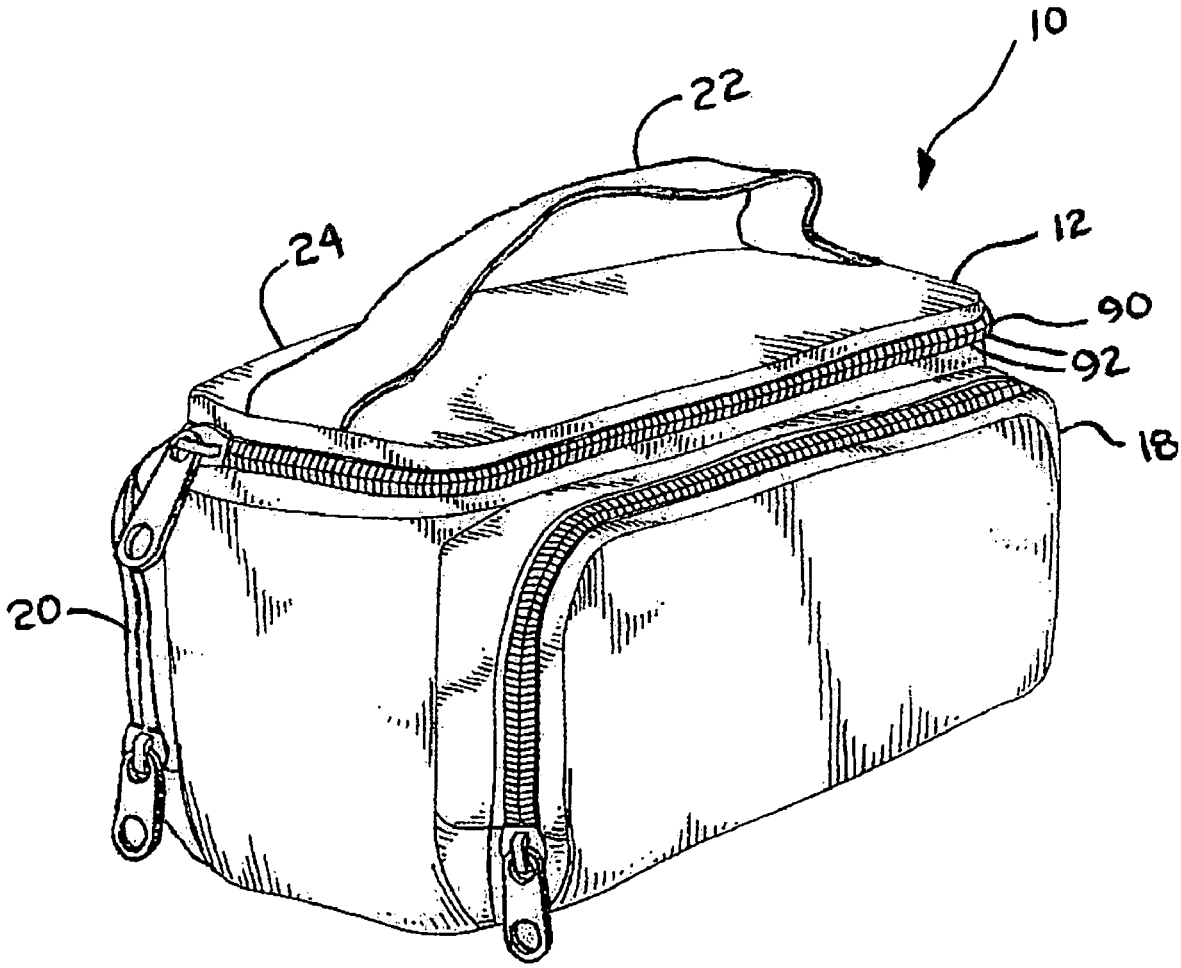
FIG. 1 is a perspective view of a transport device in a closed position.
Figure 2:
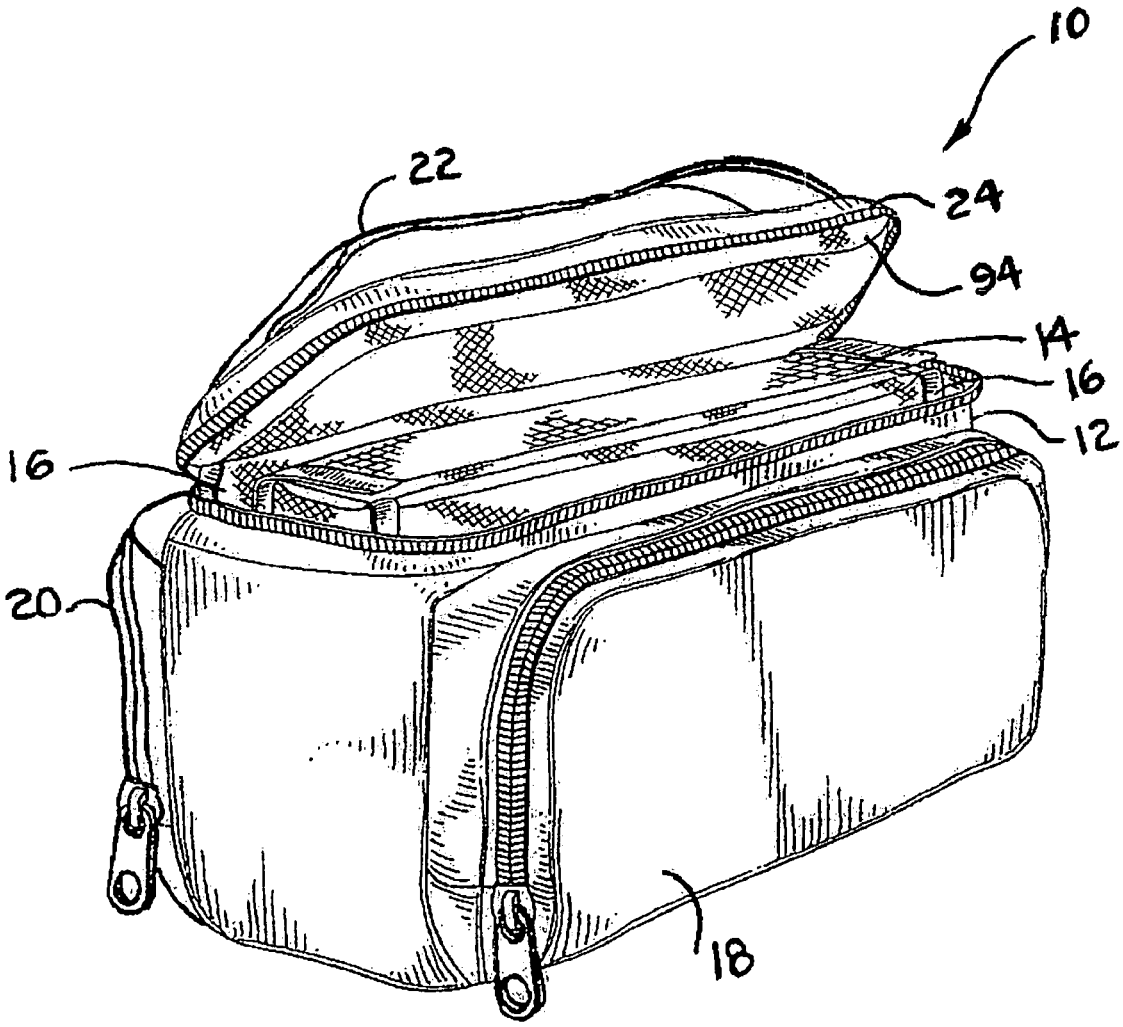
FIG. 2 is a perspective view of the transport device shown in FIG. 1 in an open position.
Figure 3:
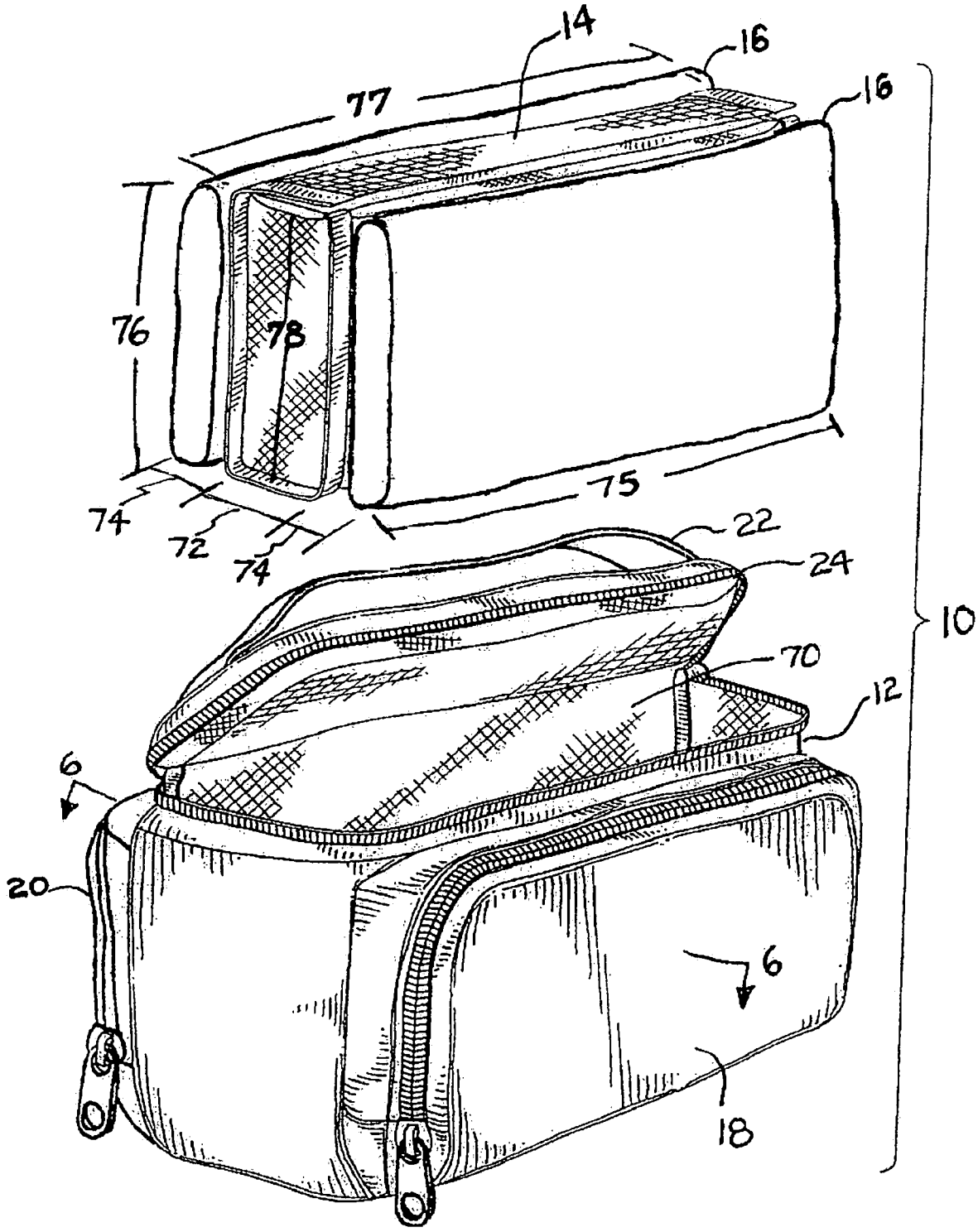
FIG. 3 is an exploded perspective view of the transport device shown in FIG. 2.

Referring to FIGS. 1-3 an insulated container 10 for providing a temperature-controlled environment for storing and/or transporting items includes a case or bag 12, an inner bag or pouch 14, and two temperature regulating devices 16, here reusable freezable gel packs. Although two temperature regulating devices 16 are shown, other quantities, e.g., one, three, etc., may be used. Further, while the devices 16 are shown as cooling devices (in particular, gel or ice packs), heating devices may be used, e.g., that release heat over a period of time, e.g., from a chemical reaction, from releasing stored heat (e.g., from being heated in a microwave oven). Also, the description below assumes the devices 16 are gel packs, but other configurations of temperature regulating devices may be used (e.g., rigid ice bricks, ice packs, thermo electric cooling devices and phase-change material that can hold a specific temperature range, e.g., not less than 32° F.). The system 10 is configured to provide a temperature-controlled environment inside at least the pouch 14, resisting temperature influence from the environment external to the container 10. The container 10 is configured to securely contain temperature sensitive materials and resist heat transfer due to conduction, convection and radiation and provide a useful, compact means to transport temperature sensitive materials. The shape of the bag 12 shown is exemplary only and not limiting as other shapes, e.g., with fewer or more sides, non-rectangular shapes (e.g., circles), etc., may be used.

The bag 12 is configured to be easily transported and to provide multiple storage compartments. The bag 12 is sized to accommodate desired contents, e.g., pharmaceuticals and related apparatus, such as needles. For example, the bag 12 may be approximately 8" long, approximately 4" wide, and approximately 4" high when closed as shown in FIG. 1. The sizes are desirable in a compact shape but exemplary only as other sizes and shapes may be used. The bag 12 includes front and rear pockets 18, 20 with resealable closures, here zippers. The pockets 18, 20 are sized to receive and hold a variety of items, such as those associated with the temperature-sensitive materials to be contained in the pouch 14, e.g., syringes, as well as accessories and other items that may not be temperature sensitive. The bag 12 as shown is made of a flexible fabric such as polyester with a waterproof backing, e.g., polyvinylchloride (PVC) backing. The pockets 18, 20 include closure mechanisms, here zippers, although other mechanisms (e.g., hook-and-loop fasteners) may be used. The bag 12 may alternatively be made, or partially made, of a rigid or semi-rigid material such as an olefin (e.g., polypropylene or polyethylene), glass filled fiber, visco elastic material, polyisocyanurate, polyurathene phenolic, a combination foam, glass and/or moisture absorbing material, and/or Styrofoam®. The bag 12 further includes a handle 22 made of nylon (although other materials may be used) and attached to either end of a top flap 24. The handle 22 may be attached to the bag 12 differently than as shown, but preferably is attached and configured to allow a person to insert a hand through the handle 22 (e.g., between the handle 22 and the bag 12 as shown, or through a loop provided by the handle if so configured) for carrying the container 10.

Figure 4:
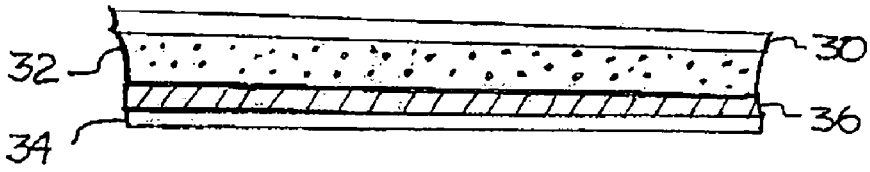
FIG. 4 is cross-sectional view of a wall of the transport device shown in FIG. 1.

Referring also to FIG. 4, the body of the bag 12 has multiple layers including an outer shell 30, an insulation layer 32, and an inner liner 34. The outer shell 30 is made of a flexible, water resistant material such as 600×600D Polyester, although other materials, including nylon or rigid or semi-rigid materials, may be used. The liner 34 comprises a thermally-reflective material such as a polyethylene-laminated aluminum foil of approximately 98-99% pure aluminum (e.g., to reflect up to about 97% of infrared energy). The liner 34 may reflect more than heat, e.g., light as well, and retain thermal cooling energy. The liner 34 may have a non-woven fabric layer 36 made of, e.g., polypropylene (PP) or other moisture-absorbing material, attached (e.g., with adhesive) to either or both sides (although only shown on an outer side in FIG. 4) of the liner 34. The liner 34 preferably includes at least one layer 36 attached to the inboard side of the liner 34 to contact the gel packs 16. This layer 36 is configured to absorb moisture, e.g., due to condensation from the gel packs 16, which may help maintain temperature stability inside the bag 12. The insulator 32 preferably provides more than about 2 R thermal insulation and more preferably at least about 3-6 R thermal insulation (about 0.167 to about 0.333 K, conductivity, value) where the higher the value generally the better material performance can be obtained. Here, the insulator 32 is preferably at least 2 mm of expanded polyethylene foam (EPE), more preferably between about 4 mm and 10 mm of EPE foam, and more preferably about 10 mm of EPE foam, as more than a single layer of 10 mm of EPE foam has been found not to significantly increase the insulating ability of the EPE foam over that provided by about 10 mm of EPE foam. A series of layers, however, with air gaps, and/or glass, and/or other materials between layers may further significantly increase the insulation ability. The insulator 32 inhibits conductive heat transfer between the inside and outside of the bag 12 through the walls of the bag 12. Thus, at least the insulator 32 and the liner 34 provide the bag with multiple insulating layers. With the insulator 32 disposed inboard from the liner 34, the liner 34 is particularly suited to repelling heat from outside the bag 12. The liner 34 may also be laminated to a flexible film or plastic laminate with trapped air (e.g., bubble wrap with laminated aluminum foil).

Figure 5:
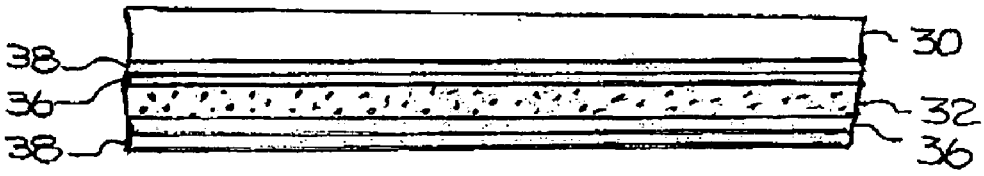
FIG. 5 is a cross-sectional view of a bottom wall of the transport device shown in FIG. 1.

Referring also to FIG. 5, at least some portions (and possibly all walls) of the bag 12 may include more than one thermally-reflective liner. For example, at least the flap 24 and a bottom panel 26 of the bag 12 preferably include an additional thermally-reflective liner 38. The liner 38 is preferably configured similarly to the liner 34, including an optional non-woven fabric layer 36 attached to one or both sides of the layer 38 (although only shown on one side of each of the liners 38 in FIG. 5). The liner 38 may be provided just inside the shell 30, or anywhere between the shell 30 and the inner liner 34 facing outwardly (e.g., with an insulating backing). The shell 30 itself may comprise a thermally reflective material. Further, the bottom of the bag 12 is preferably provided with feet preferably of insulated material (e.g., rubber) to separate the bag 12 from a surface on which the bag 12 is rested to help reduce (e.g., conductive) heat transfer from the surface to the bag 12.

Figure 6:
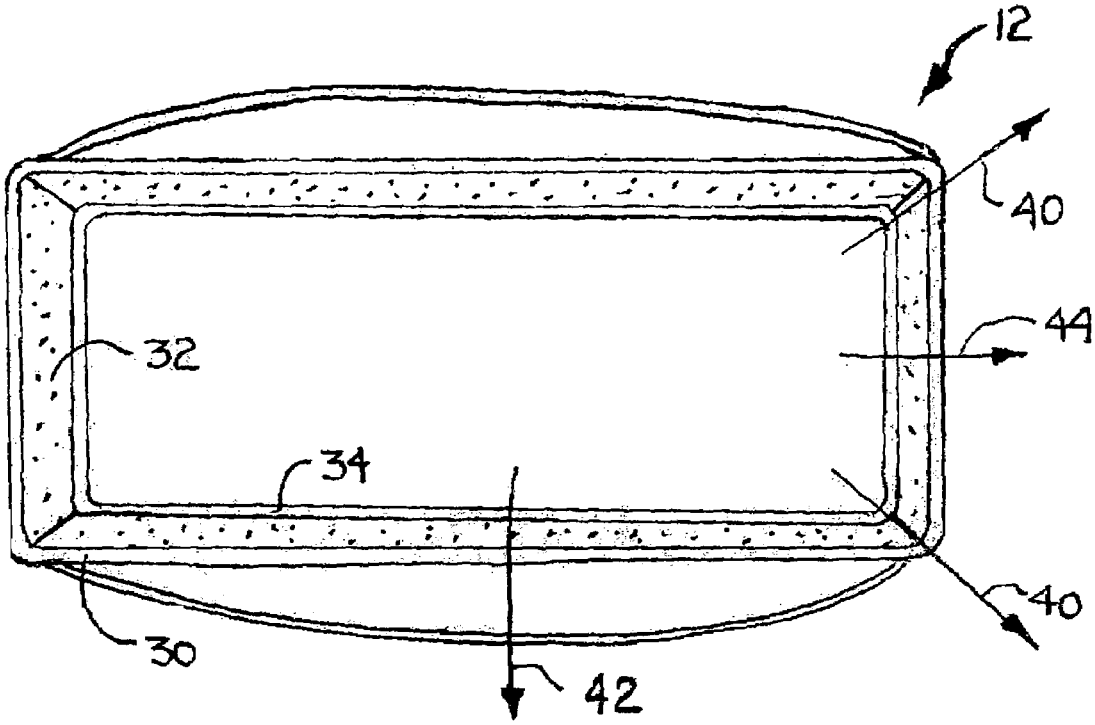
FIG. 6 is a cross-sectional view of the transport device shown in FIG. 1 taken along the line 6-6 shown in FIG. 3.

Referring to FIGS. 4 and 6, the insulator 32 of the bag 12 is preferably substantially uniform in thickness throughout the lateral perimeter of the bag 12. As a further improvement of the structure, rectangular sections of the insulation material for the four side walls of the bag 12 may be replaced with a single, continuous sheet (e.g., except for a seam where ends of the sheet meet) of insulation to form planar wall sections while maintaining a tight insulation seal. Alternatively, as shown, ends of sheets of the insulator 32 can be mitered and joined to substantially eliminate gaps in the insulation at the corners of the bag 12, preferably having insulation at least approximately as thick as the width of the insulator 32 along the walls of the bag 12. The insulator 32 substantially continuous around the perimeter of the bag 12. Other configurations than those shown and described are, however, possible. With the arrangement shown, the insulator 32 inhibits heat transfer through the corners of the bag. Indeed, the insulator 32 preferably provides about the same amount of heat transfer resistance, or more, (e.g., at least about 2R, preferably 3-6 R or more) along lines 40 through the corners of the bag 12 as along lines 42 and 44 perpendicularly through the side walls of the bag 12. Also, the bag 12 preferably has a non-woven PP layer 36 disposed on the inside surface of the reflective foil liner 34.

Figure 7:
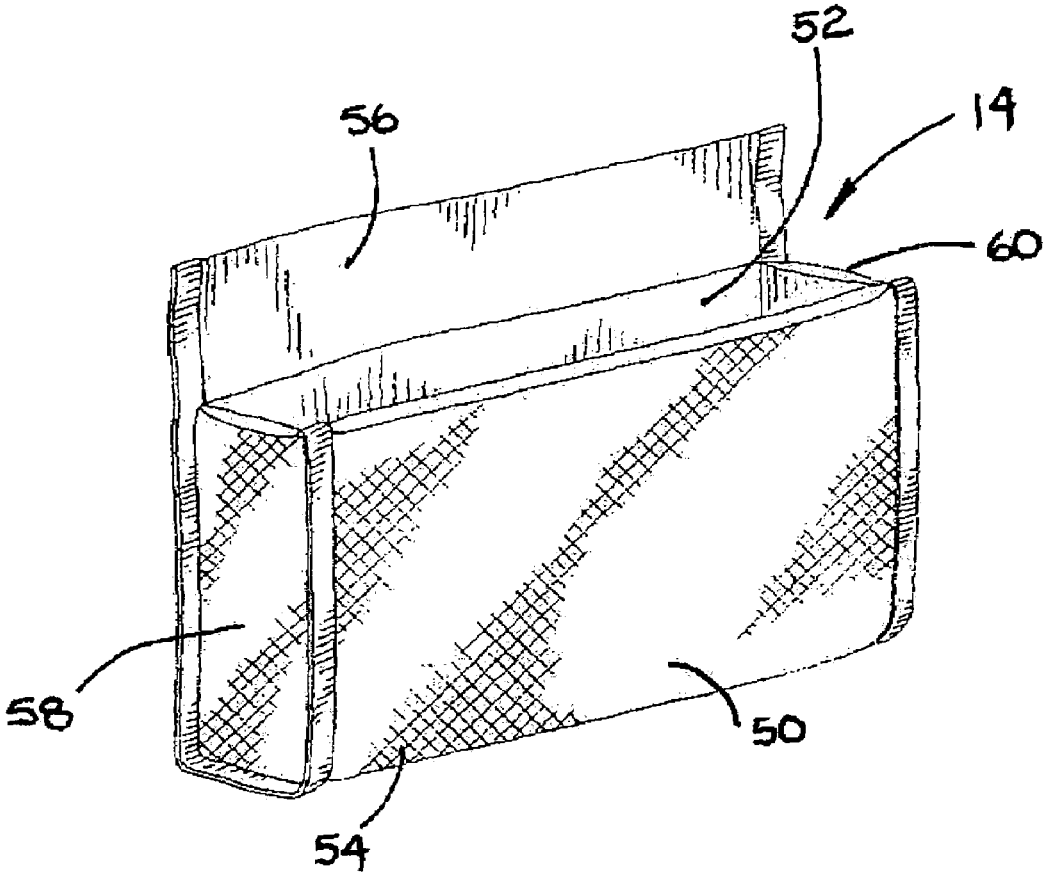
FIG. 7 is a perspective view of a pouch of the transport device shown in FIG. 2, with the pouch in an open position.
Figure 10:
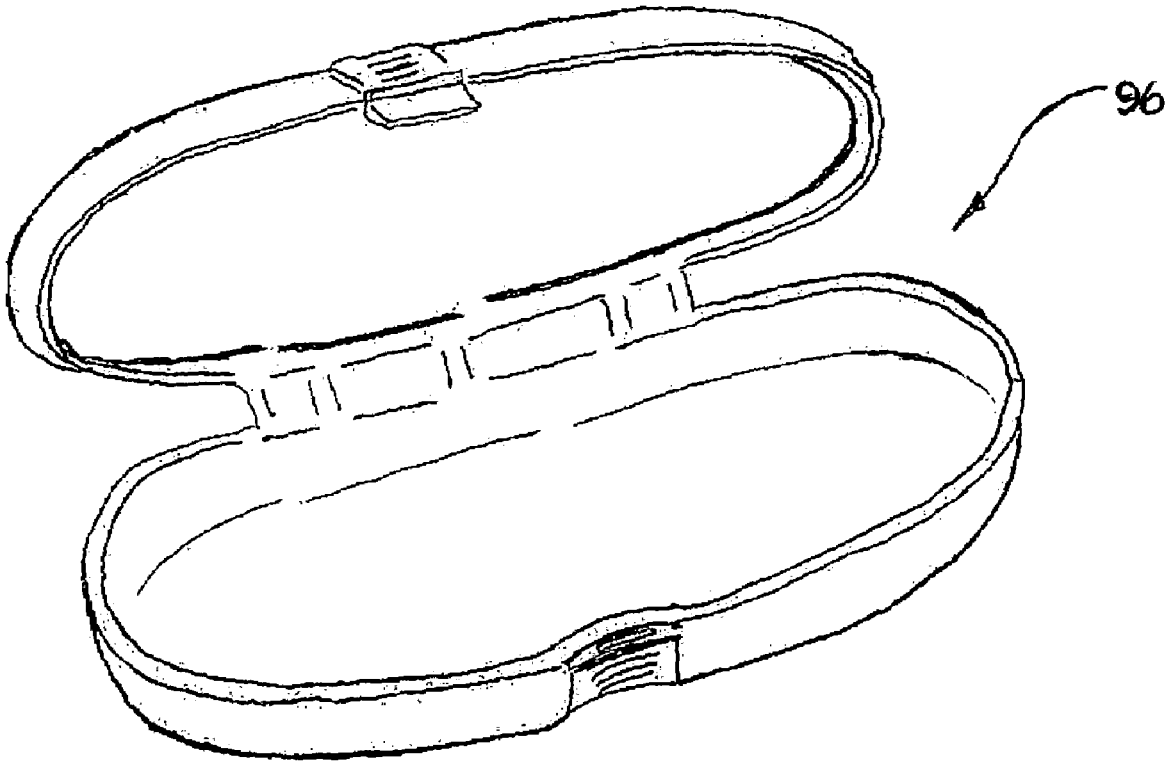
FIG. 10 is a simplified perspective view of a rigid pen-case-like package shown in an open position.

Referring again to FIGS. 1-3, with further reference to FIG. 7, the pouch 14 includes insulated walls 50, 52, 54, 56, 58, 60, with the wall 56 providing a movable lid. A seam may be provided between the walls 50 and 56 to facilitate pivoting of the lid 56 between open and closed positions. The walls 50, 52, 54, 56, 58, and 60 are constructed similarly to each other (although this is not required). Indeed, the major side walls 50, 52 and the bottom and top walls 54, 56 may be formed from a single sheet of wall material, described with respect to FIG. 8, that is attached (e.g., with nylon binding) to the minor side walls 58, 60. The pouch 14 may be made other ways, such as by sonic welding walls together, etc. The pouch 14 may be disposable, e.g., constructed from a single sheet of layered materials that is cut and folded into the shape of the pouch 14 and its walls attached to each other as appropriate. The disposable material can be made, e.g., of a non-woven cellulose fiber or hydrospun material that is laminated with a foil liner. Other cellulose materials including recycled paper, shredded recycled paper, glass fiber or PET (polyester) fiber fill and/or polyethylene and foil laminated bubble wrap can be configured to make a disposable package. The pouch 14 may be made from multiple pieces or from a single piece as desired, e.g., for economic and/or ease of manufacturing. The pouch 14 can be constructed by folding multiple layers and forming a pouch approximately 7.5"×3.5"×1.5" that can hold, e.g., up to a one-week supply of medications inside the insulated material construction. A slit can provide an opening to receive the medications, and the pouch can be sealed by means of a fastener (e.g., adhesive, hook and loop fastener, snap, etc.). The pouch 14 is configured to hold temperature-sensitive materials. These materials may be contained in various packages, such as vials or syringes, or in packages that hold multiple smaller packages. For example, referring to FIG. 10, a pen-case-like package 96, such as a plastic folding case, may be used to store temperature sensitive materials and inserted into the pouch 14 for transport.

Figure 9:
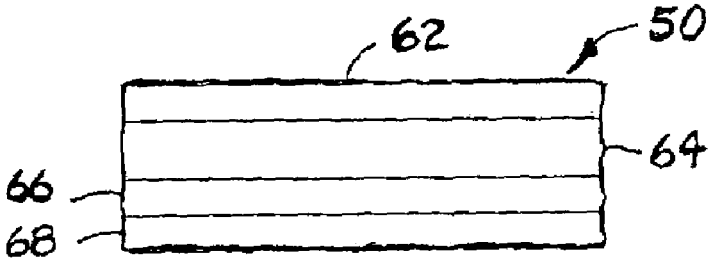
FIG. 9 is a cross-sectional view of a wall of the pouch shown in FIG. 7.

As shown in FIG. 9, the pouch walls, here the wall 50, include an inner lining layer 62, and insulator layer 64, and a reflective layer 66. The lining 62 is made of a flexible material such as nylon, although other materials, including rigid or semi-rigid materials may be used. The insulator 64 is made of EPE foam and is preferably approximately 4 mm thick. The walls 50, 52, 54, 56, 58, 60 preferably provide thermal insulation with a material having at least about 2.5 R insulation factor. The reflective layer 66 comprises a thermally-reflective material such as a polyethylene-laminated aluminum foil of approximately 98-99% pure aluminum. The layer 66 may have a non-woven fabric layer 68, e.g., made of polypropylene, attached (e.g., with adhesive) to either or both sides of the layer 66 (as shown, one layer 68 is attached to the outer surface of the pouch 14). The insulation layer 64 is configured to help prevent freezing of temperature-sensitive materials placed inside the pouch 14 with the temperature regulating devices 16 in place outside the pouch 14 and inside the bag 12.

Referring again to FIGS. 2-3, the temperature regulating devices 16 can provide heating or chilling effects. For use in transporting temperature-sensitive materials in a temperature range below ambient temperatures outside the bag 12, the devices 16 are chilling devices. Preferably, the devices 16 are flexible and include an outer thermally-reflective layer. Also, preferably, the devices 16 have the capacity to store thermal energy of about 8-16 oz of water or gel. Here, the devices 16 are re-usable gel packs. Each of the gel packs 16 contain, e.g., about 7 or 8 ounces of gel, and have a size of approximately at least about 7"× about 3.5", although other volumes and sizes may be used. Various formulations of gels may be used, e.g., water with additives, food grade cellulose gum (carboxyl methyl cellulose; CMC), food grade propylene glycol or salt (e.g. to help prevent freezing), superabsorbers (poly acrylamites), gelatin, starch or other thickening agents, etc., with preservatives such as benzoic acid possibly being included. The gel packs 16 are useful for temporarily cooling materials and are preferably reusable. The gel packs 16 can be chilled (e.g., frozen) to cool products inside the bag 12 for a period of time and can be re-chilled, e.g., after the chilling effects are no longer needed or the temperature of the packs 16 has stabilized to the ambient surrounding temperature, or the packs 16 have had a phase transition from a solid to a liquid state. Materials other than gels or water/ice are available and may be used. For example, dry ice or phase-change material (PCM) that can change state at a specific temperature from a solid to a liquid or gas and can be frozen at a specific temperature and that have a phase change at a specific temperature can be used for the devices 16. These materials may be undesirable and sometimes toxic, however, in applications with food, medicines, or other items to be ingested or otherwise put into a person's body. These PCM materials may be used to form a layer between a cooling element (e.g., frozen ice pack) and the temperature-sensitive materials, where the mass of the PCM helps assure that the temperature of the frozen material will not freeze the temperature-sensitive materials, in turn the frozen gel may store the thermal cooling energy within the body of the PCM material. The devices 16 may be surrounded by a separate non-woven layer, e.g., of PP fabric, spun cellulose fiber, etc., to help absorb moisture (e.g., due to condensation) and promote temperature stability in the container 10. For example, the non-woven fabric may be attached to the cooling element 16, or may be in the form of a sleeve, a sock or other shape into which the element 16 is inserted to provide insulation and moisture retention and provide insulation to the element and the surrounding contact surfaces.

Referring also to FIG. 7, the gel packs 16 are preferably configured to overlap substantially the entire surface areas of the major side walls 50, 52 of the pouch 14. The pouch 14 and the gel packs 16 are sized with a length 75 and a width 76 of the gel packs 16, when lying or being frozen substantially uniform and flat, being approximately the same as a length 77 and a width 78 of the major side walls 50, 52. The gel pack can further improve the temperature stability by covering substantially all of the surface area of a corresponding wall of the pouch 14.

The bag 12, the pouch 14, and the temperature regulating devices 16 are configured to have the bag 12 removably receive and contain the pouch 14 and the gel packs 16. The bag 12 provides an inner chamber 70 that is approximately the same length as the lengths of the pouch 14 and the gel packs 16, approximately the same width as a thickness 72 of the pouch 14 plus thicknesses 74 of the gel packs 16 (i.e., arranged as shown in FIG. 3), and approximately the same height as the widths 76 of the gel packs 16. The pouch 14 may be, e.g., about 7.5"×3.75"×1.5" with approximately half an inch of insulation in its walls. The gel packs 16 may be, e.g., about 7.0"×3.5"×0.5". The width 78 of the pouch 14 with the lid 56 closed (FIG. 3) is preferably slightly larger than the height of the chamber 70 such that closing of the top flap 24 (FIG. 1) of the bag 12 will close the lid 56 and help keep the pouch 14 closed. The chamber 70 has approximately the same volume as the combined volume of the pouch 14 and the gel packs 16 as shown in FIG. 2. With the pouch 14 and the gel packs 16 received by the chamber 70, and the top flap 24 shut, very little if any free moving air is disposed in the chamber 70, particularly outside of the pouch 14. With little air present, heat transfer by convection inside the chamber 70 is slight.

The container 10 is constructed to provide a specific volume or shape, where the internal compartment provides good thermal cooling capabilities, and limits heat loss. This is done by calculating the mass of the product to be cooled and the size of the ice pack and corresponding thermal efficiency to maintain the temperature inside the device using standard heat transfer equations to reduce heat losses. The pouch 14 is sized to hold a desired type and quantity of temperature-sensitive material(s), e.g., 7 vials of a drug package. The size of the pouch 14, quantity of material to be cooled, desired temperature range, ambient temperature range, duration of cooling, and heat-transfer properties of the container 10 dictate the specific amount of cooling capacity needed from the thermal cooling device. The bag 12 is preferably sized as compact as possible to accommodate the materials to be transported, the pouch 14, and the appropriate cooling elements 16. Heat transfer through convection is reduced by reducing air space inside the bag 12. Conductive heat transfer is reduced by insulating the temperature-sensitive materials and using reflective foil liners to contain the thermal cooling energy, and allowing the thermal cooling elements 16 to provide an insulating layer to the pouch 14 and provide some conductive cooling energy transfer to the materials. The radiant transfer of heat is reduced by the reflective foil liners. Preferably, the container 10 is sized as small as possible to accommodate the materials to be transferred to help minimize the effects of convective, conductive, and radiant heat transfer. The thermal cooling elements 16 can be increased volumetrically in size to provide more BTUs of thermal cooling energy, but this in turn may result in increased outer surface area and increased thermal losses, resulting in an undesirably bulky and costly container.

Referring again to FIG. 1, the bag 12 includes a zipper 90 for tightly (preferably substantially air-tight if not air-tight) sealing the chamber 70. The zipper 90 can be zipped to close the bag 12 by closing the top flap 24 and can be unzipped to open the bag 12. The zipper 90 is preferably configured to inhibit air flow, and thus heat transfer, through the zipper 90. For example, teeth 92 of the zipper may be more closely intertwined when zipped and/or may be coated, e.g., with paraffin, urethane, vinyl, rubber, or other material to help reduce or eliminate gaps and thermal losses or gains between the teeth 92 and fabric. Reusable apparatus other than a zipper may be used to close the bag 12, such as snaps, tongue-in-groove apparatus, hook and loop fasteners, etc. Also, as shown in FIG. 2, the bag 12 includes a closure flap 94 that extends away from or overlays a zipper gap and mating zipper portion to inhibit air flow through the zipper 90 (or other fastening apparatus). The closure flap 94 may various constructions, such as foil wrapped around insulation (e.g., EPE foam). A channel can be configured behind the zipper 90 of a bias or binding material on the inside of the bag 12 to provide more insulation.

Figure 8:
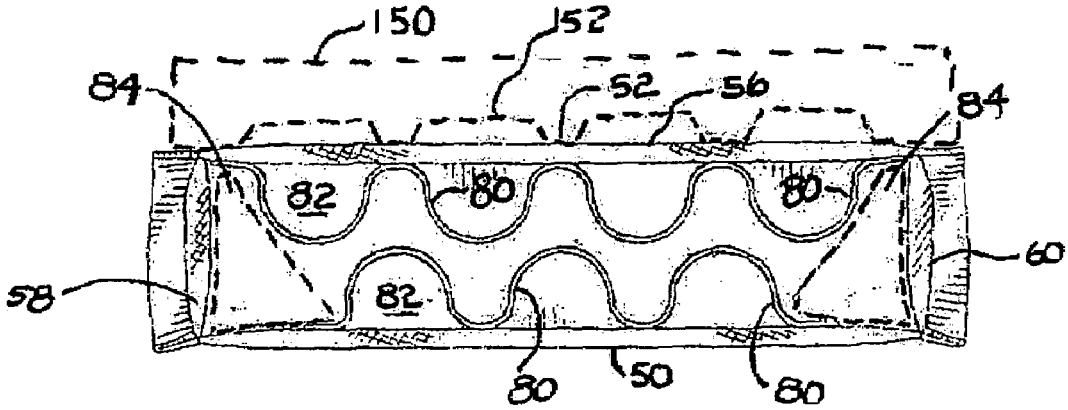
FIG. 8 is a top view of the pouch shown in FIG. 7 in the open position.

Referring to FIG. 8, the pouch 14 includes, here seven, holders 80 for holding temperature-sensitive materials inside the pouch 14. The holders 80 are formed from stretchable material such as elastic attached to the inner surface of the pouch 14 to provide openings 82 through which containers of temperature-sensitive materials (e.g., packages and/or vials of medicines) may be inserted and retained by the holders 80. The holder material may provide additional insulation. The holders 80 are configured and disposed to hold containers of temperature sensitive materials in regions in the pouch 14 that have the most stable temperature over time in the pouch 14. The holders 80 are preferably disposed in alternating fashion on either side of the pouch 14 (i.e., the wall 52 and the wall 50). Here, the pouch 14 includes seven holders 80 for holding a weeks supply of daily medication, but other quantities (e.g., 1, 3, 5) of holders 80 may be provided. Further, the holders 80 are preferably disposed and configured to hold the material containers in the pouch displaced from the end walls 58, 60. As shown, spacers 84, here insulating wedges, may be disposed in or be part of the pouch 14 to help keep containers disposed in the pouch 14 displaced from the end walls 58, 60. Preferably, the spacers 84 help keep the nearest container at least about ¾"-⅞" from the respective end wall 58, 60. The spacers 84 may be made, e.g., from an insulating material such as EPE foam, a visco-elastic material or gel, or other appropriate material. The pouch 14 is configured such that with medications (in appropriate packaging) disposed in the pouch 14, e.g., in the holders 80, little air space is preferred and available inside the pouch to help reduce convective heat transfer. The pouch 14, can also hold other packaging that may contain temperature sensitive materials (e.g., a pen case with cartridges).

The container 10 has been shown to provide a stable refrigerated temperature environment inside the pouch 14. In an exemplary configuration, using two 8 oz gel packs, refrigerated temperatures have been maintained inside pouches for extended periods of time up to about 14+ hours as tested in ambient temperature profiles from about 70° F. to about 100° F. At about room temperature, a single 8 oz. gel pack was recorded to stabilize and transform to a liquid state after about 1.5 hrs. Multiple configurations of 8 oz ice packs may incrementally increase the thermal cooling energy and time within the refrigerated temperature zone.

Figure 11:
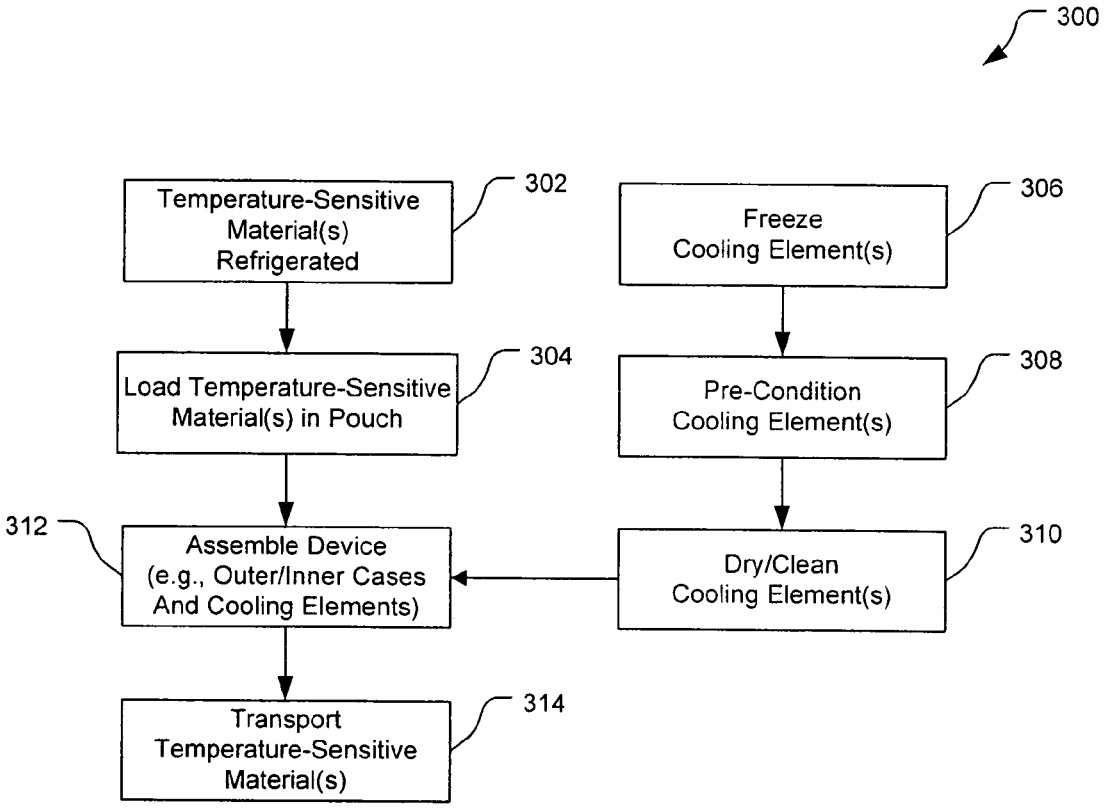
FIG. 11 is a block flow diagram of a process of preparing temperature-sensitive materials for transport and transporting them using the transport device shown in FIG. 1.

In operation, referring to FIG. 11, with further reference to FIGS. 1-3, a process 300 for transporting temperature-sensitive materials in a refrigerated environment using the container 10 includes the stages shown. The process 300, however, is exemplary only and not limiting. The process 300 may be altered, e.g., by having stages added, removed, or rearranged.

At stage 302, the temperature-sensitive materials are refrigerated. The materials may be placed in a refrigerator, cooler, or other reduced-temperature environment. Preferably, the bag 12, and the pouch 14 are also refrigerated within a temperature controlled range between about 36° F. and about 46° F.

At stage 304, the temperature-sensitive materials are arranged in the pouch 14. For example, vials of drugs may be inserted into the holders 80, or a pen-case type box can be inserted into the pouch 14.

At stage 306, the thermal cooling devices 16 are frozen. The devices 16 may be, e.g., chilled bellowed 32° F., e.g., to between 0 and 10° F. The devices 16 may be frozen for several hours to ensure complete freezing of the devices 16. For example, 8 oz of water or gel can be frozen at 10° F. for a minimum of about 10 hrs to charge the cooling device.

At stage 308, the devices are removed from the freezing environment and placed in a room temperature environment. The devices 16 are allowed to stabilize to a temperature of approximately 32° F. The time for this to occur depends, e.g., on the exterior shape and surface area of the container, ambient temperature, the particular device 16 used, e.g., type and quantity of the content of the device 16. A device with greater surface area than, but the same volume of cooling material as, another cooling device will dissipate thermal energy faster and stabilize near 32° F. faster. For a gel pack with about 7-8 oz. of gel, a shape substantially uniformly rectangular of about 7.0"×about 3.5"×about 0.50", the pack will stabilize at about 30-32° F. after about 15 minutes. The pack may be put at a room temperature of about 70-80° F. for about 10-20 minutes to help stabilize the temperature of the cooling element 16 within a few degrees of 32° F. Allowing the device 16 to warm to about 32° F. before assembling putting the devices 16 in the bag 12 with the pouch 14 containing the temperature-sensitive materials can help prevent freezing of the temperature-sensitive materials.

At stage 310, the temperature regulating devices 16 are wiped to dry and/or clean them. Drying the devices 16 to remove moisture, e.g., due to condensation while warming, can help stabilize the cooling and prolong the cooling effects of the devices 16. This stage may be bypassed, e.g., if the devices have outer layers of non-woven fabric and/or the exterior of the pouch 14 and/or the interior of the bag 12 has/have non-woven fabric layers or other moisture absorbing elements.

At stage 312, the container 10 is assembled and used to transport the temperature-sensitive materials. The pouch 14 with the temperature-sensitive materials is placed in the chamber 70 of the bag 12. The gel packs 16 are placed on either side of the pouch 14 between the pouch 14 and the walls of the bag chamber 70. The top flap 24 of the bag 12 is closed and the zipper 90 securely fastened. Closing the top flap 24 closes the top 56 of the pouch 14. The container 10 is transported as desired with the temperature-sensitive materials maintained within a desired temperature range. At stage 314, the container is transported with the temperature-sensitive material(s) in an appropriate chilled temperature range.

As shown, stages 302 and 304 can be performed in parallel with stages 306, 308, and 310.

Figure 31:
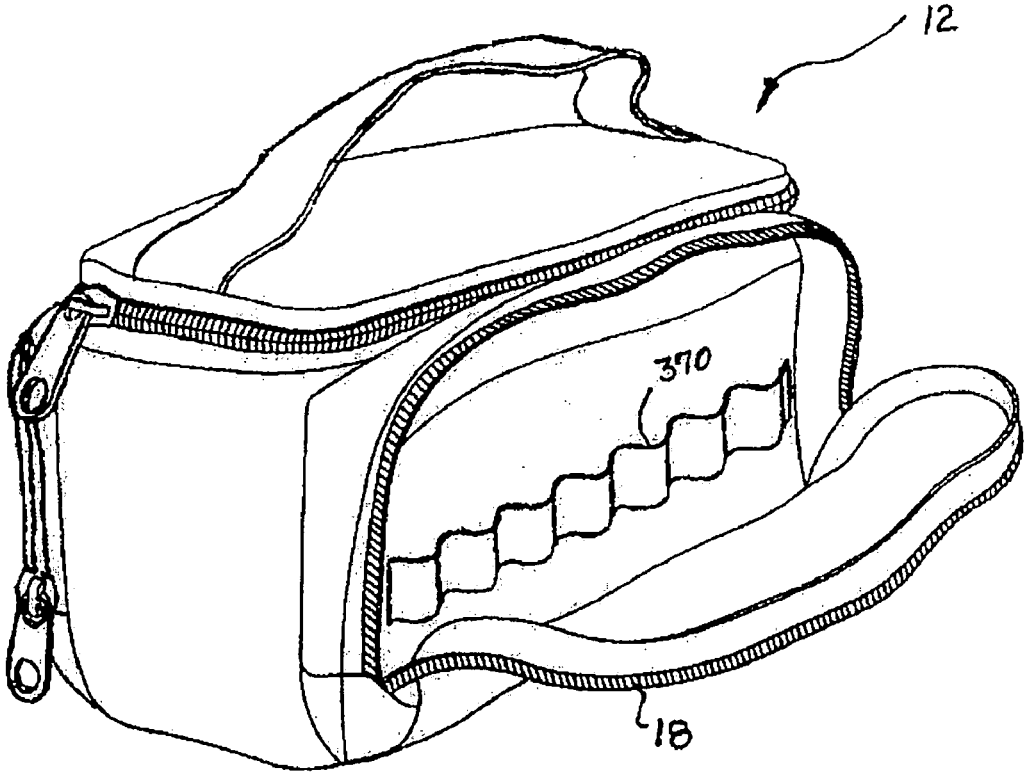
FIG. 31 is a perspective view of the transport device shown in FIG. 1 with a pocket opened.
Figure 32:
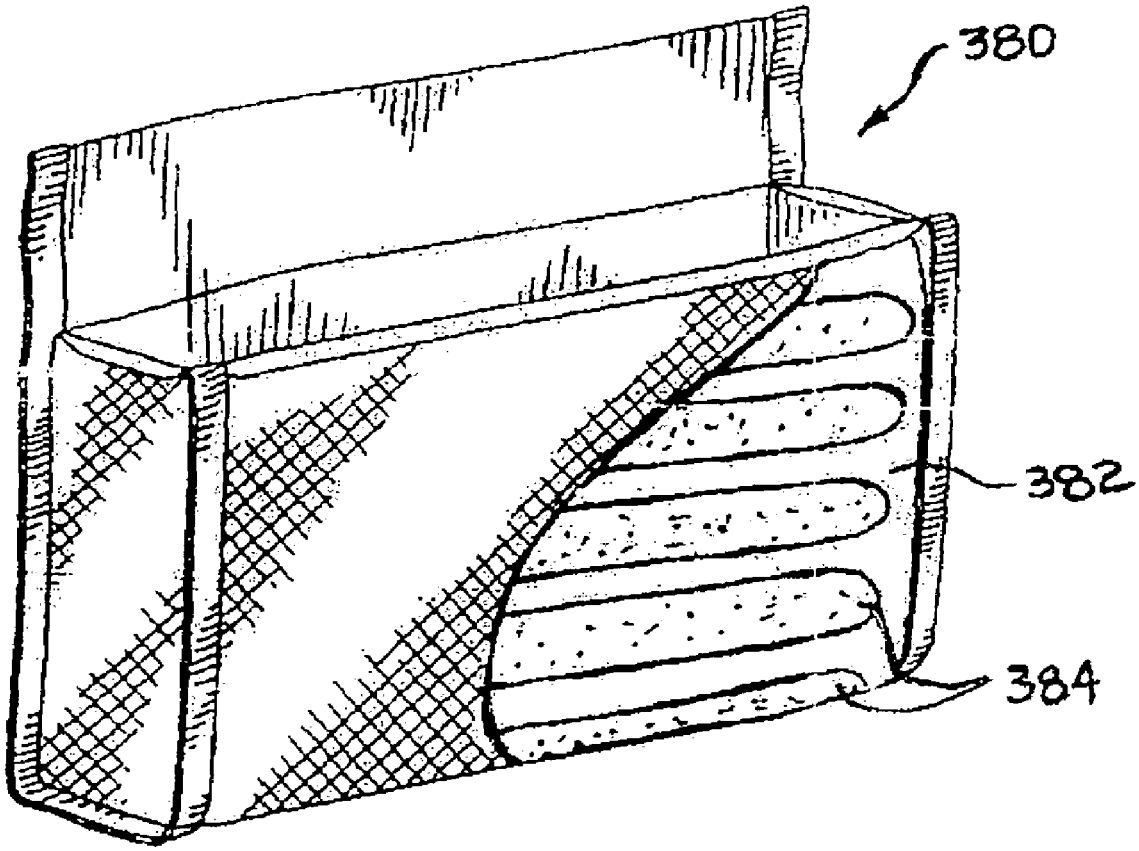
FIG. 32 is a perspective, partially cut-away view of a pouch for use with the transport device shown in FIG. 1.

Other embodiments are within the scope of the invention. For example, fewer or more than two temperature regulating devices may be used inside the bag 12. Also, while flexible materials including fabrics may be used to form the container 10, other materials including rigid or semi-rigid materials may be used to form all, part, or parts of containers in accordance with the invention (e.g., blow-molded plastic pouches/inner cases). For example, the bag and/or the pouch may be made of a hermetically sealed component (e.g., made of plastic) including insulation such as air, water, a vacuum, and/or foam. Further, the bag and/or the pouch may include temperature regulating elements (e.g., bladders) disposed in one or more of their walls. For example, referring to FIG. 32, a pouch 380 includes a cooling element 382 with tubular sections 384 containing cooling material (e.g., gel). If a cooling device is disposed in a wall of the pouch, preferably a layer of insulation is disposed between the cooling device and the temperature-sensitive material to help prevent freezing of the temperature-sensitive material. Other mechanisms may be provided to facilitate portability and/or use of insulated containers. For example, the bag 12 may be provided with a strap, e.g., a two-piece nylon strap, configured and sized to be looped and secured about an adult's waist such that the container 10 may be carried in a hand-free fashion by a person. Referring to FIG. 31, one or more of the pockets 18, 20 may include holders 370 for accessories, e.g., elastic loop holders similar to the holders 80 (FIG. 8) for the temperature-sensitive materials. Further, a desiccant (e.g., a pouch containing, e.g., silica gel, ground calcium aluminosilicate, molecular sieve) may be disposed in the bag 12, e.g., in the chamber 70 to help absorb moisture, which may adversely affect the thermal cooling capacity and/or duration of time that the temperature regulating devices 16 may effectively keep the system cool.

Insulated containers in accordance with the invention may provide one or more audible and/or visual indications regarding present or past temperature related to the temperature-sensitive material, e.g., temperature inside the pouch. Visual and/or audible alarms or warnings may be provided if the present or past temperature inside the pouch is or was outside of a desired range of temperatures. A user may be alerted that the temperature-sensitive material may have been subject to an undesired temperature.

Figure 12:
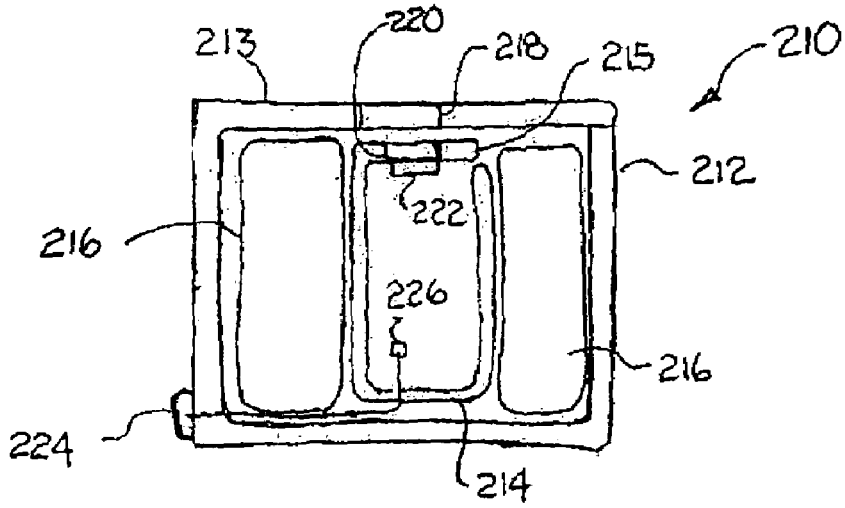
FIG. 12 is a cross-sectional view of a transport device that includes visual and audible temperature indicators.
Figure 13:
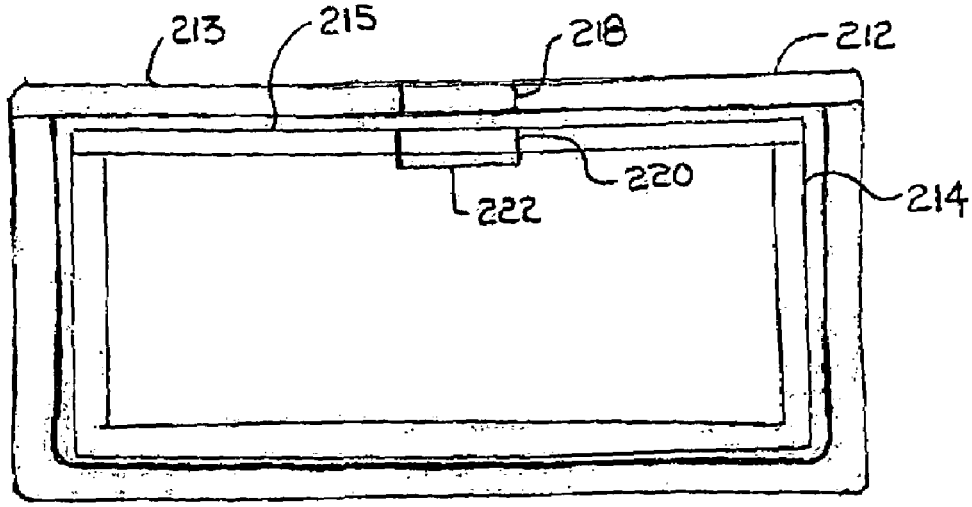
FIG. 13 is a cross-sectional view of the transport device shown in FIG. 12 orthogonal to the view shown in FIG. 12.
Figure 33:
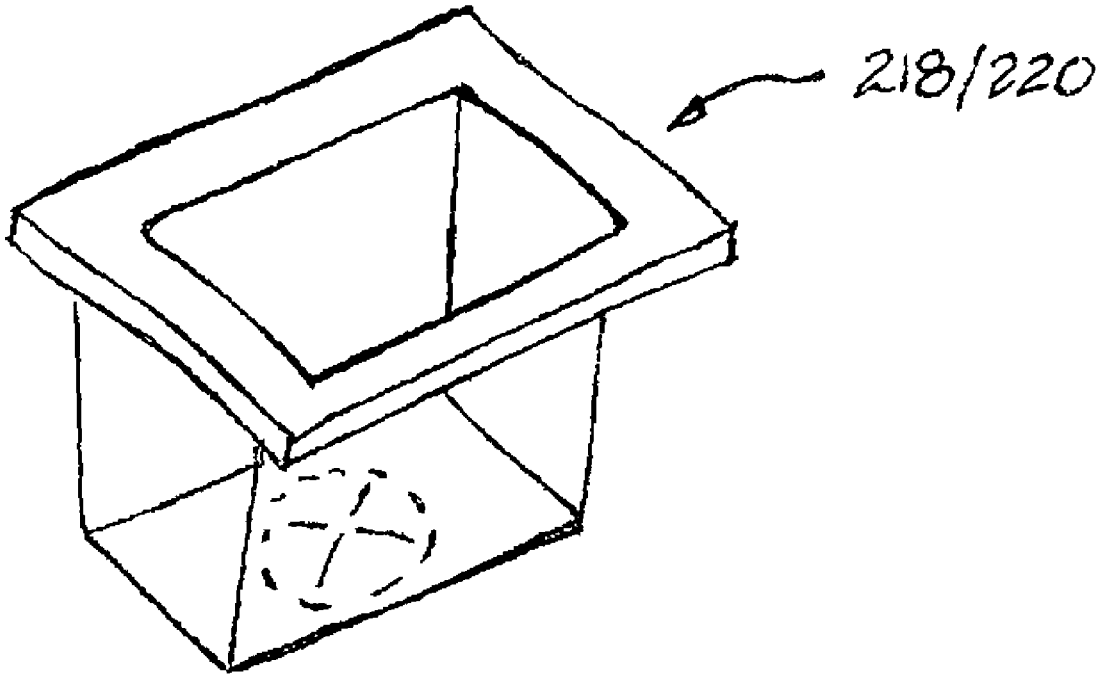
FIG. 33 is a perspective view of a temperature indicator window of the transport device shown in FIG. 12.

Referring to FIGS. 12-13, an insulated container 210 includes a bag 212, a pouch 214, and thermal cooling devices, here gel packs, 216. The bag 212 and the pouch 214 include aligned windows 218, 220 allowing a user to see through a top flap 213 of the bag 212 and a top 215 of the pouch 214 to a visual indicator 222 inside the pouch 214. The indicator 222 includes a temperature sensing material such as a thermochromatic ink or pigment, a thermistor, thermocouple, or other temperature sensing mechanism. The indicator 222 is configured to provide a visual indication of temperature inside the pouch 214, preferably in the region or regions in which temperature-sensitive materials are stored in the pouch 214. As shown, the windows 218, 220 and the indicator 222 are in the center of the bag 212 and the pouch 214, but the sensed temperature may be from a different region located within the pouch 214, in close proximity to the temperature sensitive material. The indicator 222 may be disposed outside of the pouch 214, e.g., attached to an exterior surface of the pouch 214, and configured to indicate temperature inside the pouch 214 based on knowledge of how temperature on this surface relates to temperature inside the pouch 214. Or, a temperature sensor of the indicator may be disposed on the inside of the pouch 214 and connected to the visual portion of the indicator 222 through the pouch wall to provide a direct indication of the temperature inside the pouch 214, but with a temperature indication provided outside the pouch 214. The windows 218, 220 provide transparent passages through the walls of the bag 212 and the pouch 214. The windows 218, 220 may have semi-rigid or rigid walls made of, e.g., plastic, and may be, e.g., air filled or evacuated and can provide insulation. For example, the windows 218, 220 may be PET or PVC thermo form windows (e.g., see FIG. 33). The windows 218, 220 are disposed such that with the pouch 214 disposed in the bag 212, the windows 218, 220 are in alignment such that a person can look through the windows 218, 220 to the indicator 222 without having to open the bag 212. Thus, the person can observe an indication of the temperature without affecting the temperature (e.g., by opening the bag 212 and allowing relatively warm air into the bag thereby increasing the temperature inside the pouch 214).

The visual indicator 222 may be configured in numerous different ways. For example, the indicator 222 may be an analog or a digital thermometer. The indicator 222 may be programmed or configured with a safe temperature point or range (e.g., a safe zone of 32-46° F. or 36-46° F., or at or below 46° F., etc.). The indicator 222 may have a display such as a digital liquid crystal display, and/or include a light-emitting diode or other illumination mechanism. Further, one or more thermochromatic temperature sensitive inks or pigments, temperature sensitive plastics, or other materials such as liquid crystal polymers (e.g., body temperature strips) that visually alter in response to temperature, may be used to indicate temperature. If so, then the ink may be configured, e.g., to turn opaque, turn transparent (e.g., to reveal an underlying image, text, etc.), or change color in response to an undesirable temperature being sensed. The indicator 222 may be configured to indicate whether the sensed temperature is currently acceptable, e.g., within a desired range. The indicator 222 may be configured to indicate whether the sensed temperature has deviated from a desired range, even if the current temperature is within the desired range. Preferably, if the indicator 222 is configured to act essentially as a fuse, indicating that the temperature was undesirable at some previous time, even if acceptable now, then the indicator 222 is also configured to be reset to indicate acceptable temperature until such time as the temperature again deviates from the desired range.

Figure 14:
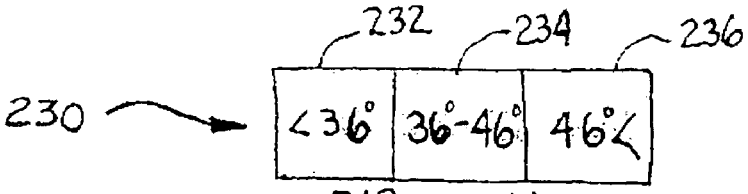
FIGS. 14-19 are exemplary visual temperature indicators.
Figure 15:
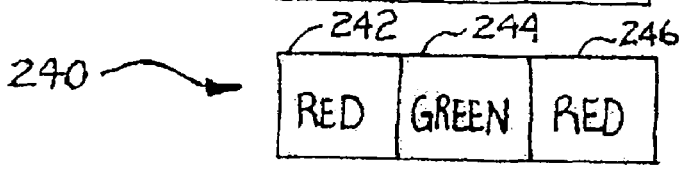
Figure 16:
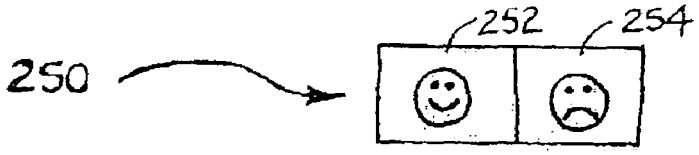
Figure 17:
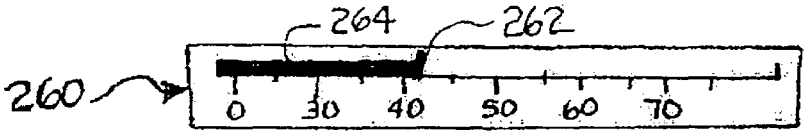
Figure 18:
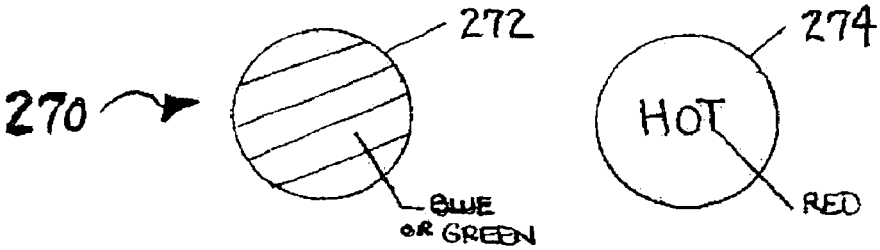
Figure 19:
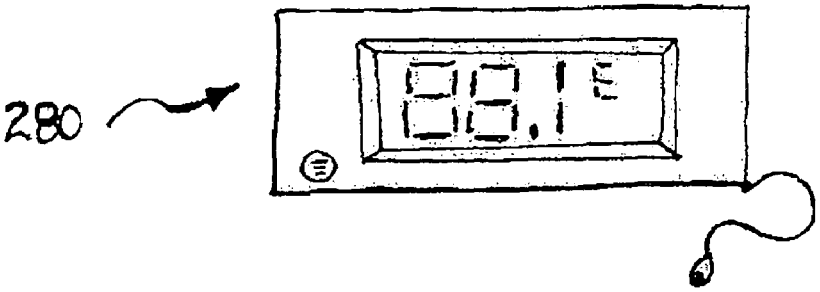

Referring to FIGS. 14-19, the visual indicator 222 shown in FIGS. 12-13 can have a variety of appearances or provide a variety of visual temperature indications. Indications can be alphabetic, numerical, alphanumeric, symbolic, chromatic, graphical, analog, digital, combinations of these, etc. As shown in FIG. 14, an indicator 230 is configured to indicate which of three ranges 232, 234, 236 of temperature the sensed temperature is in. The ranges 232, 234, 236 here correspond to temperatures below 36° F., between 36° F. and 46° F., and above 46° F., but other ranges, and more ranges (e.g., below 32° F., between 32° F. and 36° F., between 36° F. and 46° F., and above 46° F.), could be used. In this example, two of the three range indications 232, 234, 236 are obscured, e.g., by opaque colored ink, and the range 232, 234, 236 corresponding to the sensed temperature is not obscured, e.g., due to the ink for the appropriate range 232, 234, 236 becoming transparent. The ink for each section of the indicator 230 would be configured to be transparent (e.g., revealing an image) if the temperature is in the corresponding range, and opaque otherwise. Alternatively, the numbers indicating the temperature range could be formed of the thermochromatic material (e.g., ink or pigment) and be configured to be transparent if the temperature is outside the corresponding range, and opaque if inside the corresponding range. As shown in FIG. 15, a visual temperature indicator 240 includes three temperature range indications 242, 244, 246 that are white if the temperature is outside its corresponding range, and either red or green if inside its corresponding range. If the temperature is within the safe zone, then the center, green indicator 244 is apparent informing an observer that the temperature is in the safe zone. If the temperature is below the safe zone, then the left-most, indicator 242 (preferably red) is apparent and if the temperature is above the safe zone, then the right-most, indicator 246 (preferably red) is apparent. The color of the indicators 242, 246 inform the observer of the undesirable/unsafe temperature while the location of the indicator informs the observer that the temperature is either too low or too high. As shown in FIG. 16, an indicator 250 symbolically shows the temperature to be either acceptable by showing a happy face 252 or unacceptable by showing a frowning face 254. While the indicators 230, 240, 250 show different indicators disposed next to each other, the indicators may be overlaid but with only the appropriate indication being shown to an observer. As shown in FIG. 17, an indicator 260 provides a temperature scale that may be capable of displaying temperature in a continuous or incremental fashion. An observer can read the temperature from the scale as indicated, e.g., by a line 262, and/or a bar 264, or other indication mechanism provided by the indicator 260. As shown in FIG. 18, an indicator 270 includes two colored circles 272, 274 (although other shapes may be used). If the temperature is in a safe zone, then the circle 272 is visible in a color, such as green or blue, commonly associated with being acceptable or cool. If the temperature is outside the safe zone, then the circle 274 is visible in a color, such as red, commonly associated with being unacceptable or hot. Additionally, text may be provided in either circle 272, 274, such as "HOT" as shown in the circle 274. Alternatively, only text (or other image) may be visible in either of the circles 272, 274, and this text may be of a color associated with the notice intended by the text, e.g., red for unacceptable temperature. When one circle 272, 274 is shown, the other circle 272, 274 is preferably not visible or at least not colored and any text or other image in the circle 272, 274 is not visible (e.g., although an outline of the circle 272, 274 may be visible). As shown in FIG. 19, a temperature indicator 280 provides digital numerical temperature readout. An observer of the indicator 280 determines what action to take, if any, depending upon the indicated temperature.

Other forms of visual indicators are acceptable. For example, indications of temperatures near the extremes of the safe zone may be provided so that the observer can take appropriate action. For example, if the indicator 222 indicates that the temperature is in the safe zone, but near the upper limit, then the observer may take steps to put the bag 212 into a refrigerator, or replace the gel packs 216 with frozen gel packs. If the indicator 222 indicates that the temperature is in the safe zone, but near the lower limit, then the observer make take steps such as opening the bag 212 and pouch 214 to raise the temperature in the pouch 214. Indications of temperatures near the extremes of the safe zone can also take a variety of forms, such as yellow text, symbols, images, or other indicia, with yellow being commonly associated with caution be appropriate. As another example, if the desired safe zone is 36-46° F., then the indicator 222 may be configured to be red if the temperature is below 32° F. or above 46° F., green if the temperature is between 36° F. and 46° F., and yellow for cautionary indication if the temperature approaches 32° F.

Figure 20:
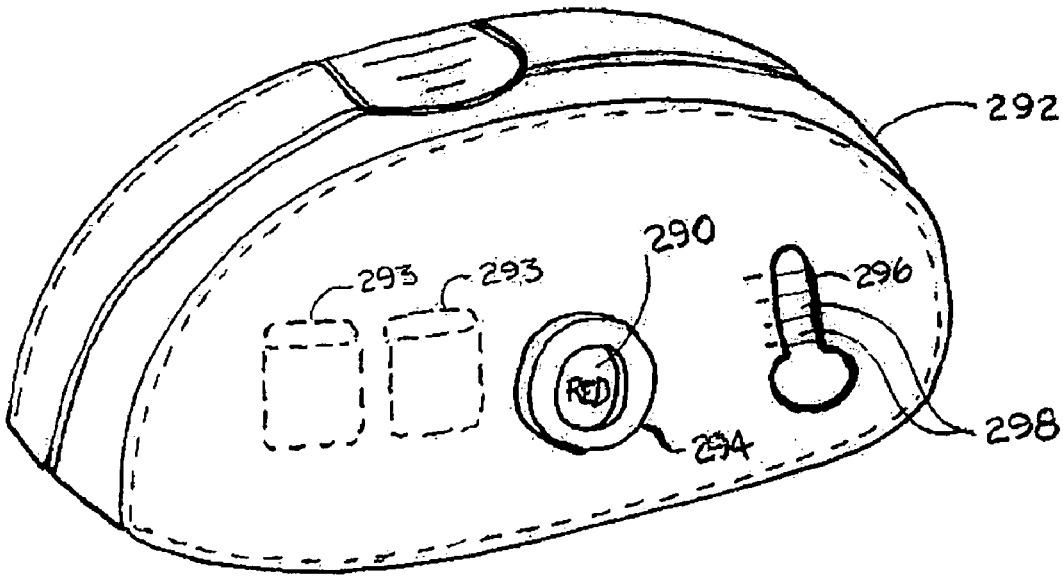
FIG. 20 is perspective view of a thermal cooling device that includes visual temperature indicators.

Still other forms of visual temperature indicators are acceptable. For example, referring to FIG. 20, a case 292 includes a visual indicator 290 and temperature-sensitive materials 293. The indicator 290 comprises thermochromatic material disposed on an internal wall or internal portion of the inner case 292 that is configured to change from one color to another (e.g., blue or green to white) if the temperature in the vicinity of the material exceeds a predetermined limit of safe zone temperature. Another visual indicator 296 is shaped like a graphical icon of temperature indicia (e.g., a thermometer) made from a series of thermochromatic materials 298 that each change color as the temperature reaches at least a corresponding temperature for each material, to thereby incrementally indicate the temperature. The bag, case and/or pouch may be configured with a thermochromatic material such as ink or plastic such that the bag, case and/or pouch itself/themselves change color in accordance with temperature in the vicinity of the temperature-sensitive material.

Referring again to FIG. 12, an audible indicator 224 is provided on the bag 216. The audible indicator 224 can be, e.g., a speaker, buzzer, or other transducer for providing a sound indication, from power from a power source in the indicator 224 and/or a temperature sensor 226 in the pouch 214, in response to a signal indicating temperature in the pouch 214 from the temperature sensor 226. Preferably, the indicator 224 sounds an alarm if the temperature deviates from the safe zone temperature range. The indicator 224 may provide different sounds depending upon whether the temperature exceeds the maximum safe zone temperature or drops below the minimum safe zone temperature. The indicator 224 may provide warning sounds if the temperature is within, but is approaching or is near to an extreme, of the safe zone. Further, a separate audible indication may be provided if the temperature falls below a temperature at which materials in the pouch 214 may solidify and/or freeze (e.g., 32° F.). Different types of audible indicators may be used, e.g., to produce single tones, and/or words, etc.

The visual indicator 222 and/or the audible indicator 224 may include an integrated circuit or other programmable device. The programmable device can be programmed with the safe zone temperature range, and/or any other thresholds or relevant temperature points for which one or more indicia are to be provided (e.g., within the safe zone but near, e.g., within 1-2° F. of an extreme of the safe zone, below 32° F., etc.). Such a device may be preset by a manufacturer and/or programmed and/or re-programmed by an end user. The programmable temperature indicating device may be used to store data or to track the temperature profile within various transportation methods and ambient temperature conditions.

Figure 21:
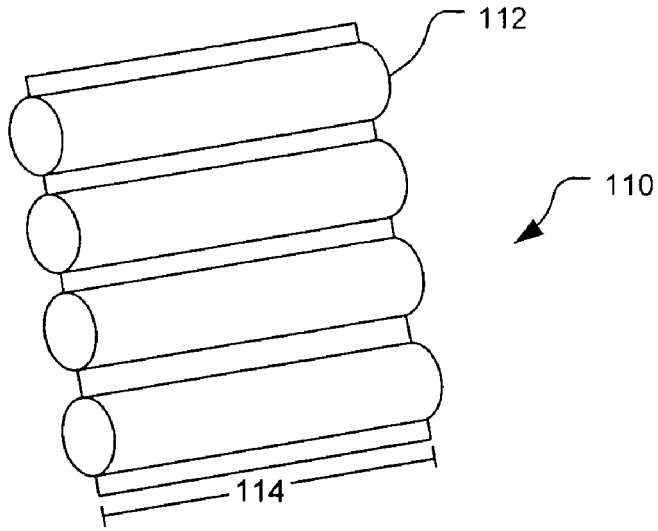
FIG. 21 is perspective view of a portion of a foldable temperature regulating element that includes tubes of cooling material.
Figure 22:
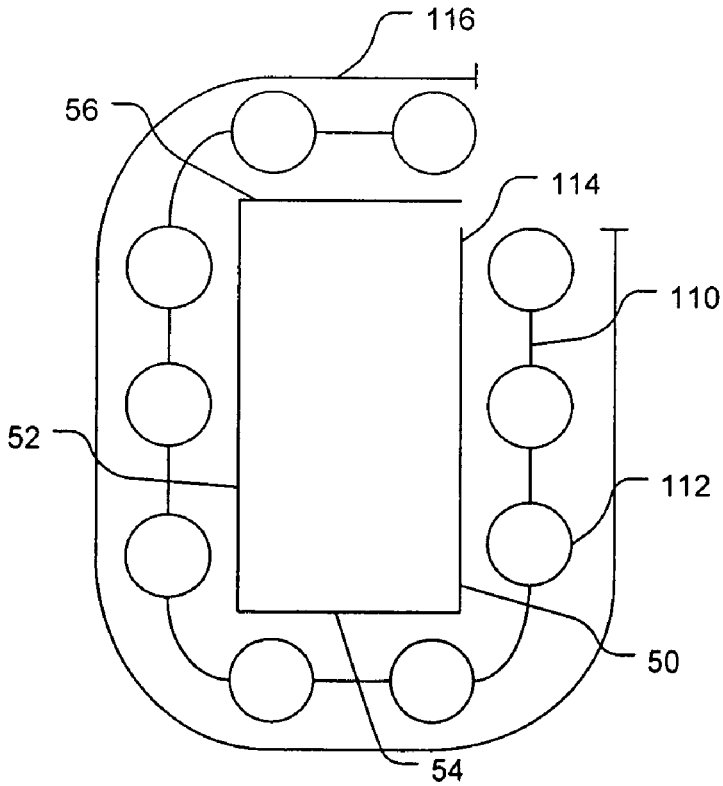
FIG. 22 is a side view of the temperature regulating element shown in FIG. 21 disposed about a pouch.
Figure 23:
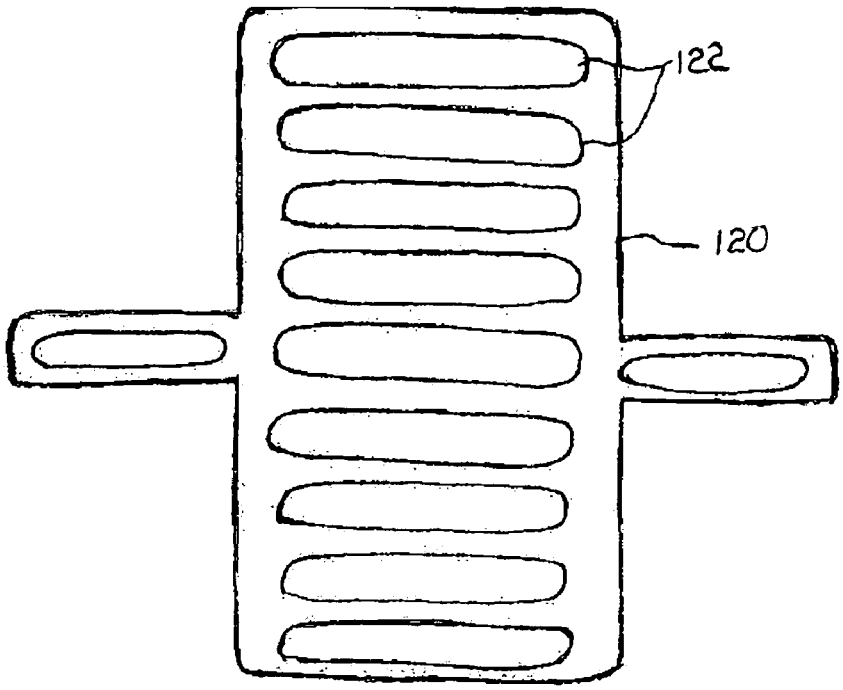
FIG. 23 is a top view of an alternative foldable temperature regulating element that includes pockets of cooling material.
Figure 24:
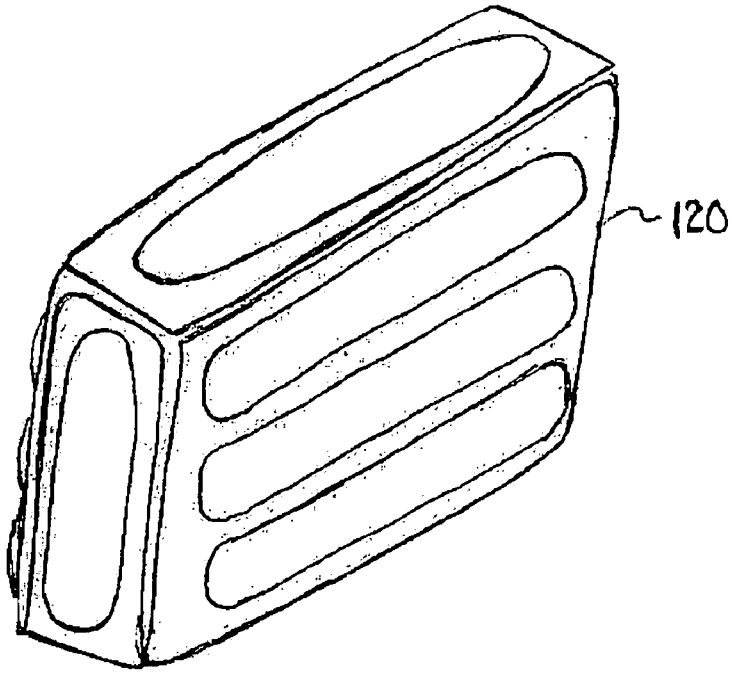
FIG. 24 is a perspective view of the temperature regulating element shown in FIG. 23 disposed about a pouch.

Further, the temperature regulating device(s) may be configured differently than as shown. For example, referring to FIGS. 21-22, a temperature regulating device 110 may comprise multiple refreezable portions 112 connected together. As shown, the elongated refreezable portions 112 are tubularly shaped, although other shapes may be used. The temperature regulating device 110 is preferably configured to have lengths 114 of the pockets 112 approximately equal to the length 77 of the pouch 14, and a span 116 of the pockets 112 such that the device 110 can wrap or fold around the walls 50, 52, 54, 56 of the pouch with the pockets 112 disposed about at least substantially all of the perimeter of the pouch walls 50, 52, 54, 56. Referring to FIGS. 23-24, a temperature regulating device 120 includes a two-dimensional array of pockets 122 containing refreezable material of a specific volume sized appropriately to cool the chamber of the bag (e.g., about 8-20 oz of material). As shown, the pockets are substantially tubular along one plane, although other shapes may be used. The device 120 is preferably shaped to be folded about all six walls 50, 52, 54, 56, 58, 60 of the pouch 14. Alternatively, a temperature regulating device may have a similar shape as, but slightly larger than, the pouch 14 such that the device may receive the pouch 14 within the device and be closed to substantially surround the pouch 14. Still other configurations for the temperature regulating device may be used. The device may comprise at least one surface of resilient reflective foil-like material. The bag would be configured to accommodate the particular temperature regulating device and the pouch, preferably leaving little air such that the device and the pouch is snugly received by the bag.

Figure 25:
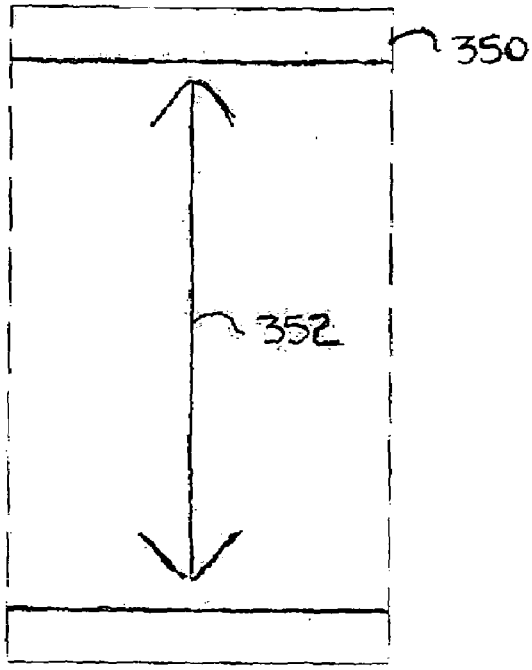
FIG. 25 is a simplified top view of an alternative temperature regulating element configured to inhibit uneven distribution of its contents.

Referring to FIG. 25, a temperature regulating element 350 may be configured to retain a relatively flat shape. The element 350 is a gel pack that includes a heat seal seam 352 (although more than one seam 352 could be used) approximately in the center of the element 350 along its length. The seam 352 divides the element 350 essentially in half and reduces the ability of gel in the element 350 to be distributed unevenly. Thus, the element 350 will be more likely to be frozen in a relatively flat shape than without the seam 352. Techniques other than seams may be used, e.g., insertion of semi rigid materials, divider walls, to help reduce the ability of the contents of a temperature regulating element to be distributed unevenly, which can result in uneven cooling effects being provided along the length or width of the element. Materials such as a honeycomb or perforated uniform shape of olefin plastic or EPE foam would be desirable to insert into the flexible package of the temperature regulating element 350.

Still other forms of temperature regulating elements may also be used. For example, a thermoelectric module may be powered by a portable power source, such as a DC battery, and configured to pump heat from inside the container 10 to cool contents of the container 10.

Other quantities of temperature regulating devices may be used. While at least two temperature regulating devices are preferred, only one such device may be used. Further, more than two temperature regulating devices may be used. Preferably, the bag 12 is configured such that the chamber 70 snugly receives the pouch 14 and the device(s). Further, the temperature regulating devices need not all be sized or shaped the same or similarly.

Figure 26:
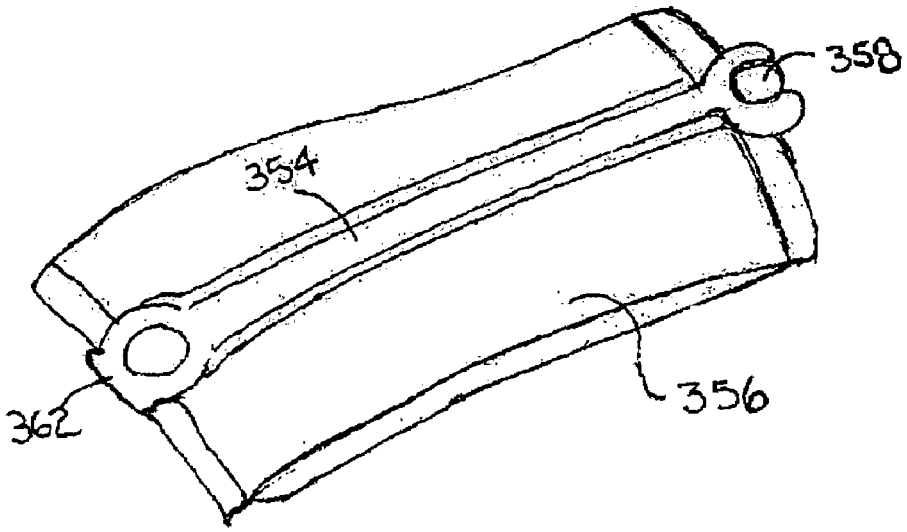
FIG. 26 is a simplified perspective view of a temperature regulating element disposed in a device configured to retain the temperature regulating element is a substantially flat configuration.

Referring to FIG. 26, a biased clip 354 may used in conjunction with thermal cooling element 356 to help ensure that the element freezes substantially uniformly in shape (e.g., flat). Here, the clip 354 is shown as two members 358, 360 adjoined and hinged at one end and joined by mechanical means at the opposing end, to evenly distribute the material inside the thermal cooling element 356. The members 358, 362 are rigid and may be, e.g., Polypropylene, and configured to keep the body of the thermal cooling element flat and uniform. The clip 354, along with the thermal cooling element (e.g., flexible gel pack) may be more economical compared to a rigid brick ice pack alternative (e.g., blow molded container filled with materials for refrigeration). The cost of the thermal cooling element 356 (e.g., flexible gel pack) and clip 354 are anticipated to be about 0.20 USD each as opposed to an anticipated cost of about 0.60 USD each for a brick ice pack. The clip 354 can be configured to cover a portion of the thermal cooling element 356 or substantially the entire surface area to provide a protective barrier to the package. The element 356 is frozen with the clip 354 in place such that the element 356 is frozen substantially flat to provide substantially evenly distributed cooling. The clip can be retained on the cooling element 356 during use of the element in a container. Other forms of clips could be used, e.g., spring clips, rods, or flat plates can be disposed down the middle of the element 356, and fewer or more bias mechanisms could be used.

Figure 27:
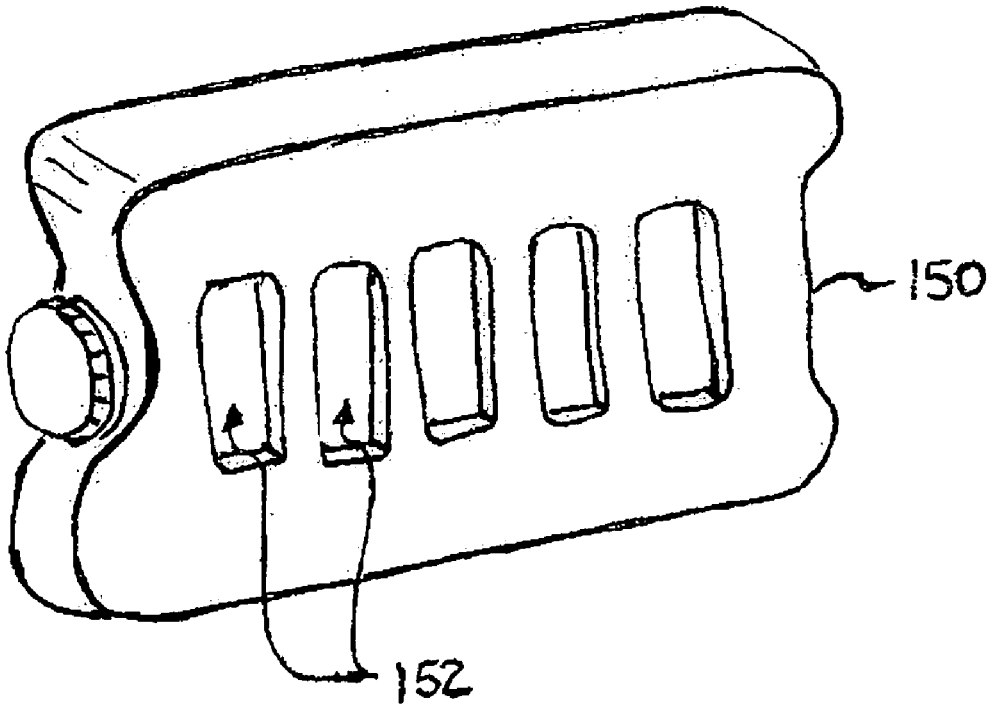
FIG. 27 is a simplified perspective view of an alternative temperature regulating element with recesses.

Further, referring to FIGS. 27 and 8, a temperature regulating device 150 is configured to provide multiple indentations 152 disposed along its length. Although four recesses 152 are shown, other quantities such as one, two, three, or more than four indentations could be used. Here, the indentations 152 are disposed to correspond to and align with the four holders 80 on the upper side of the pouch 14 as shown in FIG. 8. The device 150 is configured such that when medications are placed in the holders 80 and the pouch 14 and the device 150 are placed in the bag 12, the device 150 is separated from the wall 52 in alignment with the medications such that the thermal cooling provided by the device 150 to the medications is reduced compared with not having the indentations 152, to help prevent freezing of the medications. The device 150 is preferably made of a rigid material such as a rigid plastic.

Numerous variations of the pouch 14 may be used. Pouches may be configured to provide a low cost portable storage component, e.g., by injection molding a three dimensional shape with a living hinge closure, and/or heat or pressure forming plastic film and sheet materials such as polyester, olefins, and vinyl. The pouch can be fabricated and fastened by combining or processing a multi layer sheet or individual layers of reflective material, insulation material, and a liner material. For example, the pouch can be fabricated from stacking and die cutting a layered sheet of a shell material, an insulator, and a heat reflector, and heat sealing or sewing the cut sheet into a three dimensional structure and securing the structure with a bias fastening means at opposing sides of the pouch.

Figure 28:
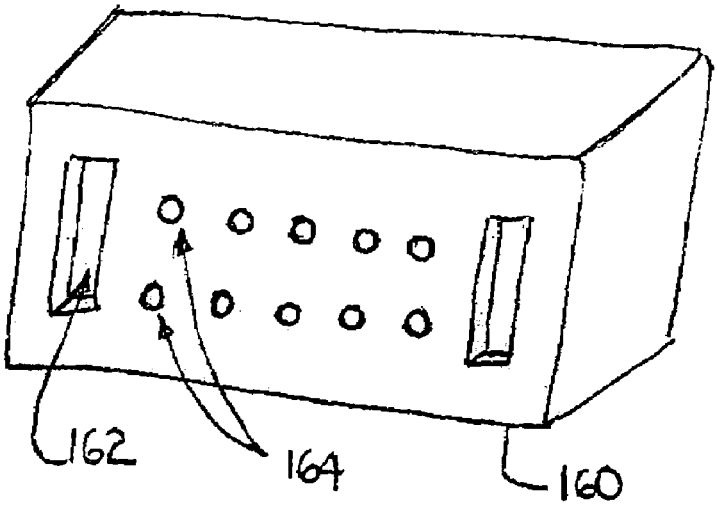
FIG. 28 is a simplified perspective view of an alternative pouch including recesses and holes, with the pouch shown in a closed position.
Figure 29:
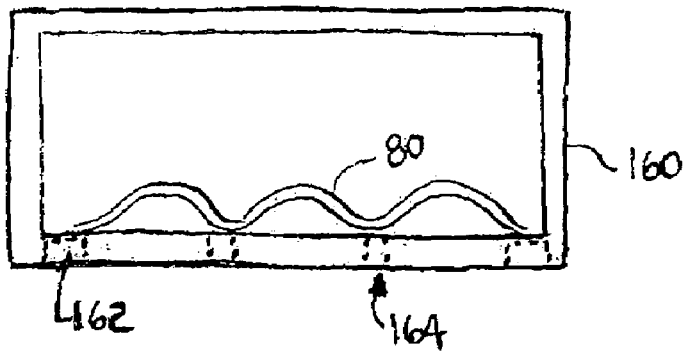
FIG. 29 is a simplified top view of the pouch shown in FIG. 28, with the pouch in an open position.

Further, pouches may be provided with indentations, holes, or other mechanisms to increase heat transfer through the pouch. Referring to FIGS. 28-29, a pouch 160 includes indentations 162 and provides holes 164. The indentations 162 correspond to reduced thickness of insulation 166 in the pouch 160 and the holes 164 provide regions of no insulation. Thus, thermal cooling is increased in these regions compared to regions of full insulation thickness. Preferably, the indentations 162 and holes 164 are disposed to be aligned between the holders 80 of the pouch 160 to help inhibit freezing of materials in the holders 80. The holes 164 are shown arranged in lines, but other arrangements, including random arrangements are possible, but the holes 164 would still preferably not align with any of the holders 80. The holes 164 may be of various sizes, but holes with diameters of about ⅛" have been found to be effective.

The pouch 14 may be used in various ways. It may be placed in the bag 12 along with the thermal cooling devices 16 and used to transport temperature-sensitive materials. It may be used to store materials while in a refrigerator while inside the bag 12 or separate from the bag 12. The pouch 14 can be used to transport materials for short time intervals with the cooling elements 16 or the bag 12. The pouch may include a closure, e.g., a strap with appropriate fastener (e.g., snap, hook and loop fastener, etc.) for such uses. The pouch may be reversible (e.g., turned inside out) such that the temperature sensitive materials can be in contact with the thermal cooling elements after a period of time, or when the thermal cooling elements are stabilized about or above 36° F.

Figure 30:
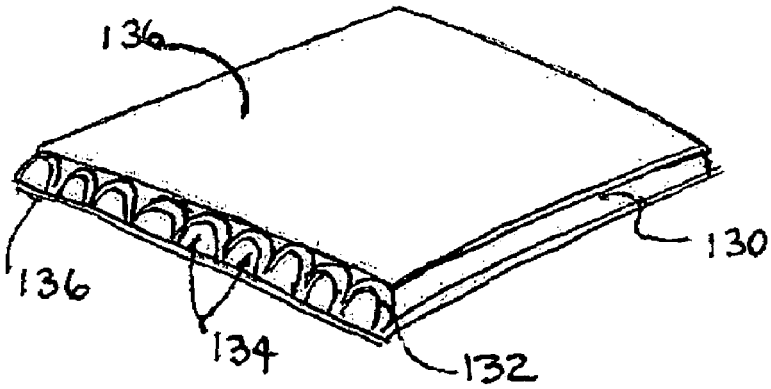
FIG. 30 is a simplified perspective view of an alternative insulator comprising a fluted sheet.

Various insulation materials can be used for the insulator layers 32, 64 either alone or in combination. For example, water or a visco-elastic gel can be cooled to help increase thermal cooling efficiency by storing thermal cooling energy within the case or insulating layer of material. As other examples, Styrofoam®, PP board, and/or PU foam may be used instead of EPE. The EPE insulation may be configured with a reflective foil laminate. Further, aluminum, expanded polystyrene foam, and/or liquid solutions such as water with a binder or filler to help store thermal energy from the cooling elements may be used. As another example, a polyethylene air embedded insulator (bubble pack) may be used as an insulator, e.g., in place of the EPE foam layer 32. As another example, referring to FIG. 30, an insulator 130 includes ribs, pockets or channels 132 that provide, here elongated, chambers 134. The insulator 130 is preferably made of a rigid plastic, such as an olefin board, although other materials of different composition and/or stiffness may be used. The insulator 130 may be configured similarly to fluted boards used for packaging for shipping goods. The chambers 134, however, may be evacuated or have insulation inserted into them and ends of the insulator 130 sealed. The insulator 130 may be configured (e.g., like the device 120 shown in FIG. 23) to form a package and can be nested with one or more other layer(s) of the insulation 130, or other insulators, if desired. The insulator 130 can be made into a temperature regulating device by inserting into the chambers 134 materials such as liquid or cooling gel to provide thermal cooling after refrigeration or freezing. The insulator 130 may have one or two flat walls 136 and a thermally reflective material may be attached to either of the walls 136. The insulator 130 may be used in place of the insulator 32 for the bag, and/or for the insulator 64 for the pouch 14. The insulator 130 may be removed and washed. Multiple layers of the insulator 130 may be sealed with alternating layers of glass or other insulating materials. Honeycomb or woven configurations of insulation materials configured (e.g., sealed) to inhibit penetration of air may improve the insulation provided and decrease cost, e.g., by reducing material weight and/or due to air trapped inside voids in the honeycomb or woven configurations. A polyurethane and polyisocyanurate structure (e.g., with foil laminated liners) made of this configuration may provide lower material cost and optimum effects for insulation. Also a structure made of eflute section for insulated panels, filled with a thermally conductive material or gas (which may include a layer of material laminated to hermetically seal or reduce vapor or gas transmission) can provide an insulated panel that increases the time for refrigeration within limits desired. A calculation can help determine the materials and volume needed to maintain the desired temperature or empirical data from controlled experiments may be used to determine the material and amounts to be used.

Further, a tube that includes a valve may be provided through the bag 12 such that air inside the chamber 70 may be evacuated. This may be done to help reduce convective heat transfer between contents of the bag 12 and the external environment.

Materials described as layers may be single layers or materials, or themselves combinations of layers of materials. For example, the insulation layer 32 and/or the reflective layer 34 may be single layers, or combinations of layers, e.g., laminated together.

The container is preferably configured for ease of portability. For example, the bag 12 may be sized and of a weight to be hand held. Or, the bag may be configured as a backpack. Preferably, the bag is no larger than a backpack and the container (including the bag, pouch, and cooling elements) is no heavier than about 5-10 pounds.

Further, while the description refers to "the invention," more than one invention may be disclosed. The specific embodiments discussed are exemplary only and not limiting as other embodiments, including modifications and adaptations of the described embodiments are within the scope of the invention. The described embodiments do not define the limits of the invention but illustrate specific embodiments thereof.

What is claimed is:

1. A portable thermally-controlled system comprising:

an outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case;

an inner case configured to be removable and configured with a thermally reflective layer of material, an insulation layer or material and an opening configured to receive temperature sensitive materials within a second inner chamber, the inner case is further configured to substantially fill the inside inner chamber provided by the outer case with a cooling element, the inner case sized relatively smaller but approximately equal to the geometric shape of the said side wall panels of the outer case dimension; the inner case insulation layer configured to prevent thermal cooling elements and the temperature sensitive materials to be in contact; including a thermally-reflective layer and an insulation layer disposed and;

a cooling element configured to be disposed in the first inner chamber with the inner case and wherein the inner case and the cooling element are configured to substantially fill the first inner chamber with the outer case in the closed position, the system configured to maintain a desired temperature inside the inner case for transport of temperature sensitive materials.

2. The system of claim 1 wherein the outer case includes a second thermally-reflective layer and a second insulation layer disposed outwardly of the second thermally-reflective layer.

3. The system of claim 2 wherein the first and second thermally-reflective layers comprise an aluminum foil.

4. The system of claim 2 wherein at least one of the inner and outer cases has a non-woven fabric layer adjacent to its corresponding thermally-reflective layer.

5. The system of claim 1 further comprising a temperature indicator configured to provide an indication of a temperature in the second inner chamber, the indication being detectable outside of the outer case while the outer case is in the closed position.

6. The system of claim 5 wherein the temperature indicator comprises a thermochromatic ink.

7. The system of claim 5 wherein the temperature indicator is configured to provide an indication of whether the temperature in the second inner chamber is in a safe zone.

8. The system of claim 5 wherein the indication is at least one of visible and audible.

9. The system of claim 1 wherein the inner case includes a side wall with a first shape and wherein the cooling element has a side wall with a second shape that is substantially similar to the first shape.

10. The system of claim 1 wherein the cooling element includes a plurality of separate cooling volumes connected together such that the cooling element is configured to be wrapped around multiple walls of the inner case.

11. The system of claim 1 wherein the inner case includes a plurality of adaptive holders configured to hold multiple sizes of packages containing temperature-sensitive materials.

12. The system of claim 11 wherein the adaptive holders are disposed and configured to hold the packages in the inner case away from end walls of the inner case.

13. The system of claim 1 wherein at least one of the outer case and the inner case includes a cooling element configured to be repeatedly frozen and thawed disposed in a wall of the respective case.

14. The system of claim 1 wherein the outer case comprises an insulation layer that is substantially uniform in thickness about a lateral perimeter of the outer case.

15. The system of claim 1 wherein the outer case includes a first body and a first lid pivotally connected to the body, the case further comprising a closure mechanism configured to releasably connect the lid to the body in a substantially air tight manner.

16. An insulated container system for transporting temperature-sensitive materials in a cooled environment inside the system for extended periods of time while the system is exposed to higher temperatures than in the cooled environment, the system comprising:

an outer case including a first lid an outer shell layer, a first insulation layer, and a first liner layer, the first liner layer comprising a first thermally-reflective material, the insulation layer being disposed between the outer shell layer and the first liner layer, the outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case;

an inner case configured to fit in the chamber provided by the outer case, wherein the inner case includes a second lid pivotally coupled to a second body and wherein the second body is slightly taller than the first inner chamber such that when the first lid is pivoted from an open position to a closed position to close the outer case, the first lid will interfere with the second lid, causing the second lid to pivot toward the second body into a closed position, to securely seal the container system.

17. An insulated container system for transporting temperature-sensitive materials in a cooled environment inside the system for extended periods of time while the system is exposed to higher temperatures than in the cooled environment, the system comprising:

an outer case including an outer shell layer, a first insulation layer, and a first liner layer, the first liner layer comprising a first thermally-reflective material, the insulation layer being disposed between the outer shell layer and the first liner layer, the outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case;

an inner case configured to fit in the chamber provided by the outer case, the inner case including a second liner layer and a second insulation layer, the second liner layer comprising a second thermally-reflective material, the second insulation layer being disposed inwardly of the second liner layer, the inner case providing a second inner chamber disposed inwardly of the second insulation layer; and at least one cooling element configured to be repeatedly frozen and thawed by absorbing thermal energy;

wherein the inner case and the at least one cooling element are configured to substantially fill the first inner chamber.

18. The system of claim 17 further comprising temperature indicating means connected to at least one of the inner case and the outer case for providing an indication of temperature in the second inner chamber.

19. The system of claim 18 wherein the indication is at least one of visible and audible.

20. The system of claim 18 wherein the indicating means includes a window through the outer case for viewing the indication without opening the outer case.

21. The system of claim 18 wherein the temperature indicating means is configured to indicate whether the temperature is between about 36° F. and about 46° F.

22. The system of claim 18 wherein the temperature indicating means is configured to indicate that the temperature is between about 36° F. and about 46° F. but near at least one of 36° F. and 46° F.

23. The system of claim 17 wherein the inner case further comprises a non-woven fabric layer disposed outwardly of the second liner layer.

24. The system of claim 17 wherein the outer case further comprises a non-woven fabric layer disposed inwardly of the first liner layer.

25. The system of claim 17 wherein the at least one cooling element includes a non-woven fabric outer layer.

26. The system of claim 17 wherein at least a portion of the outer case further includes a third liner layer disposed between the outer shell layer and the first insulation layer and comprising a third thermally-reflective material.

27. The system of claim 17 wherein the first and second liner layers comprise an aluminum foil.

28. An insulated container system for transporting temperature-sensitive materials in a cooled environment inside the system for extended periods of time while the system is exposed to higher temperatures than in the cooled environment, the system comprising:

an outer case including an outer shell layer, a first insulation layer, and a first liner layer, the first liner layer comprising a first thermally-reflective material, the insulation layer being disposed between the outer layer and the first liner layer, the outer case providing a first inner chamber and configured to have an open position and a closed position, when in the open position the outer case is configured to receive items into the first inner chamber and when in the closed position the outer case is configured to inhibit heat transfer between the first inner chamber and a region external to the outer case;

an inner case configured to fit in the chamber provided by the outer case, the inner case including a second liner layer and a second insulation layer, the second liner layer comprising a second thermally-reflective material, the second insulation layer being disposed inwardly of the second liner layer, the inner case providing a second inner chamber disposed inwardly of the second insulation layer; and at least one cooling element configured to be repeatedly frozen and thawed by absorbing thermal energy; and a temperature indicator configured to sense temperature inside of the inner case and to provide an indication of the temperature that is observable outside of the outer case without opening the outer case;

wherein the inner case and at least one cooling element are configured to substantially fill the first inner chamber.

29. The system of claim 28 wherein the inner case includes a first thermally-reflective layer and a first insulation layer disposed inwardly of the first thermally-reflective layer.

30. The system of claim 28 wherein the outer case includes a second thermally-reflective layer and a second insulation layer disposed outwardly of the second thermally-reflective layer.

31. The system of claim 28 wherein the temperature indicator is configured to indicate whether the temperature is within a desirable temperature range.

32. The system of claim 31 wherein the temperature indicator is configured to indicate whether the temperature is near an extreme of the desirable temperature range.

33. The system of claim 28 wherein the temperature indicator is disposed through a wall of the inner case.

34. The system of claim 33 wherein the temperature indicator comprises a window through the inner case.

* * * * *